US009573013B2

(12) United States Patent
Lopez

(10) Patent No.: US 9,573,013 B2
(45) Date of Patent: Feb. 21, 2017

(54) SYSTEMS AND METHODS FOR PHYSICAL EXERCISE

(71) Applicant: Robert P. Lopez, San Jose, CA (US)

(72) Inventor: Robert P. Lopez, San Jose, CA (US)

(73) Assignee: Robert P. Lopez, San Jose, CA (US)

( * ) Notice: Subject to any disclaimer, the term of this patent is extended or adjusted under 35 U.S.C. 154(b) by 1 day.

(21) Appl. No.: 14/477,693

(22) Filed: Sep. 4, 2014

(65) Prior Publication Data

US 2016/0067541 A1 Mar. 10, 2016

(51) Int. Cl.

| | |
|---|---|
| ***A63B 21/02*** | (2006.01) |
| ***A63B 21/055*** | (2006.01) |
| ***A63B 21/00*** | (2006.01) |
| *A63B 22/14* | (2006.01) |

(52) U.S. Cl.

CPC ..... *A63B 21/0552* (2013.01); *A63B 21/1488* (2013.01); *A63B 21/0004* (2013.01); *A63B 22/14* (2013.01)

(58) Field of Classification Search

CPC .. A63B 21/0552; A63B 21/1488; A63B 22/20
See application file for complete search history.

(56) References Cited

U.S. PATENT DOCUMENTS

| | | | | |
|---|---|---|---|---|
| 2,972,162 | A * | 2/1961 | Townsend | F16C 29/046 16/26 |
| 3,809,393 | A | 5/1974 | Jones | |
| 4,134,584 | A | 1/1979 | Rosenbusch | |
| 4,768,778 | A * | 9/1988 | Thomas, Jr. | A63B 22/14 482/141 |
| 5,358,463 | A | 10/1994 | Fuentes | |
| 5,632,707 | A | 5/1997 | Daniel et al. | |
| D428,454 | S | 7/2000 | Fischer et al. | |
| 6,254,518 | B1 | 7/2001 | Yu | |
| 6,582,347 | B2 | 6/2003 | Smith | |
| 6,773,379 | B1 | 8/2004 | Bing | |
| 6,942,605 | B1 | 9/2005 | Sukhovitsky | |
| 6,979,285 | B2 | 12/2005 | Lovison | |
| 7,377,888 | B2 | 5/2008 | Godbold | |
| 7,468,025 | B2 | 12/2008 | Hauser et al. | |
| 7,481,753 | B2 * | 1/2009 | James | A63B 21/4035 482/140 |
| 7,553,267 | B1 * | 6/2009 | Hauser | A63B 21/00047 482/141 |
| D597,153 | S | 7/2009 | Friedman et al. | |
| 7,621,858 | B2 | 11/2009 | Sheron | |
| 7,896,789 | B2 | 3/2011 | Hinton et al. | |
| 7,935,039 | B2 * | 5/2011 | Dannenberg | A63B 22/14 482/141 |

(Continued)

*Primary Examiner* — Loan H Thanh
*Assistant Examiner* — Megan Anderson
(74) *Attorney, Agent, or Firm* — Geeta Kadambi; Riddhi IP LLC

(57) ABSTRACT

Provided herein is an apparatus including a top member configured to couple with an anatomical appendage or a structure thereof; a bottom member rotatably attached to the top member; and a movement-enabling means for enabling the apparatus to move across a surface substantially without interruption, wherein the movement-enabling means comprises a turntable bearing between the top member and the bottom member, and a rolling mechanism about a bottom surface of the bottom member.

10 Claims, 35 Drawing Sheets

(56) References Cited

U.S. PATENT DOCUMENTS

| | | | | |
|---|---|---|---|---|
| 7,935,040 | B2 * | 5/2011 | Moskowich | A63B 23/12 482/141 |
| 7,981,016 | B1 | 7/2011 | Howard | |
| 8,016,732 | B2 * | 9/2011 | Susnjara | A63B 21/0004 482/142 |
| D666,684 | S | 9/2012 | Meininger et al. | |
| 8,827,879 | B2 * | 9/2014 | Nicholas | A63B 21/0004 482/131 |
| 2006/0035771 | A1 | 2/2006 | Gant | |
| 2007/0298947 | A1 | 12/2007 | Eksteen | |
| 2009/0298656 | A1 | 12/2009 | Dannenberg | |
| 2010/0210431 | A1 | 8/2010 | Hinton et al. | |
| 2012/0238420 | A1 | 9/2012 | Meininger et al. | |

* cited by examiner

SYSTEMS AND METHODS FOR PHYSICAL EXERCISE

BACKGROUND

Physical exercise reduces stress and improves overall health. Physical exercise includes a number of different training methods, including strength training, which includes creating a force resistant to contraction of one or more muscles. While strength training is generally performed to increase muscle strength and size, there are many other benefits as well. Such benefits include improved cardiac function, posture, and joint function; reduced potential for injury; and increased metabolism and bone density.

SUMMARY

Provided herein is an apparatus including a top member configured to couple with an anatomical appendage or a structure thereof; a bottom member rotatably attached to the top member; and a movement-enabling means for enabling the apparatus to move across a surface substantially without interruption, wherein the movement-enabling means comprises a turntable bearing between the top member and the bottom member, and a rolling mechanism about a bottom surface of the bottom member.

The foregoing and other features of the invention may be better understood with reference to the drawings, description, and appended claims.

DRAWINGS

Figure 1A:
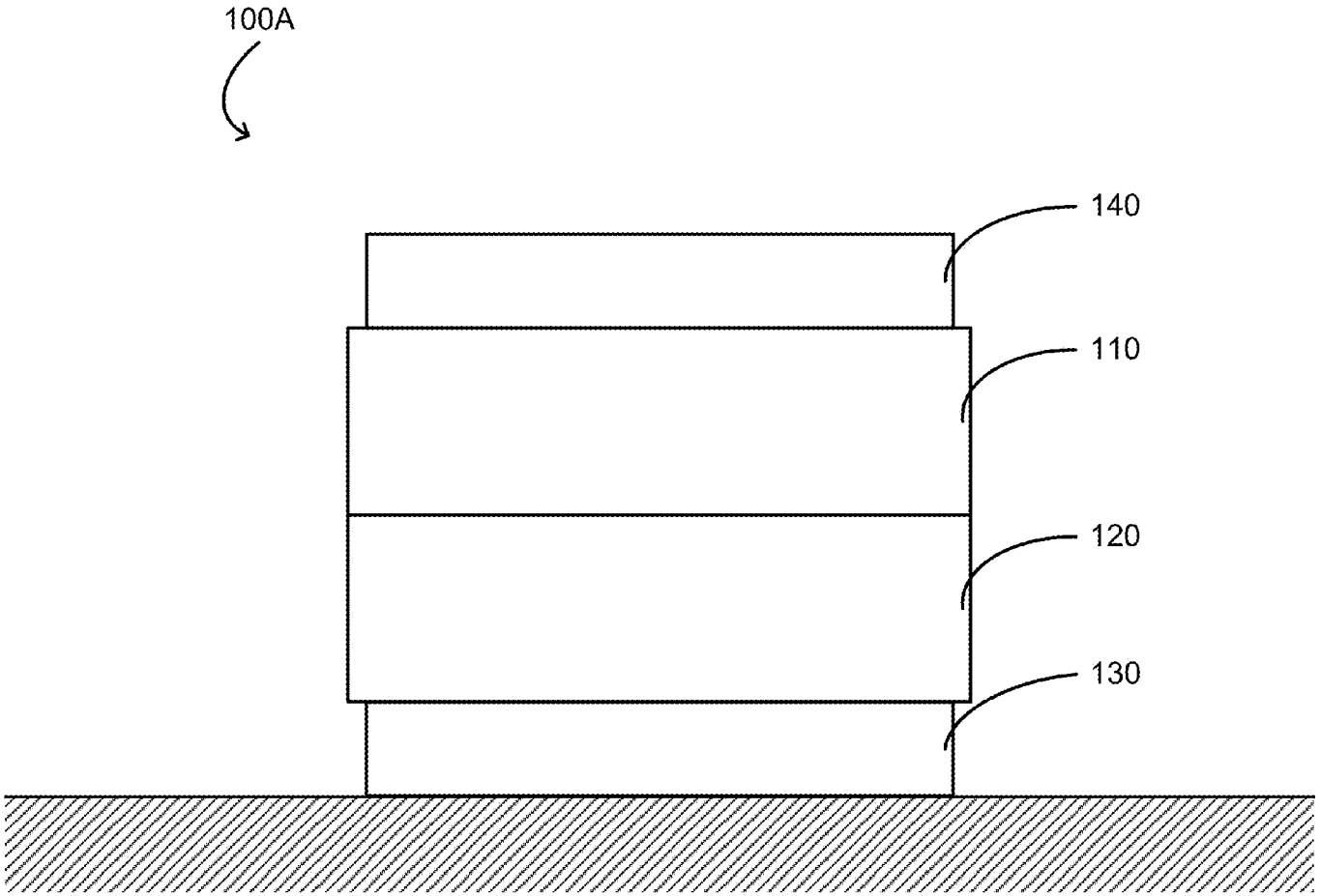

FIG. 1A provides a schematic of an apparatus in accordance with some embodiments.

Figure 1B:
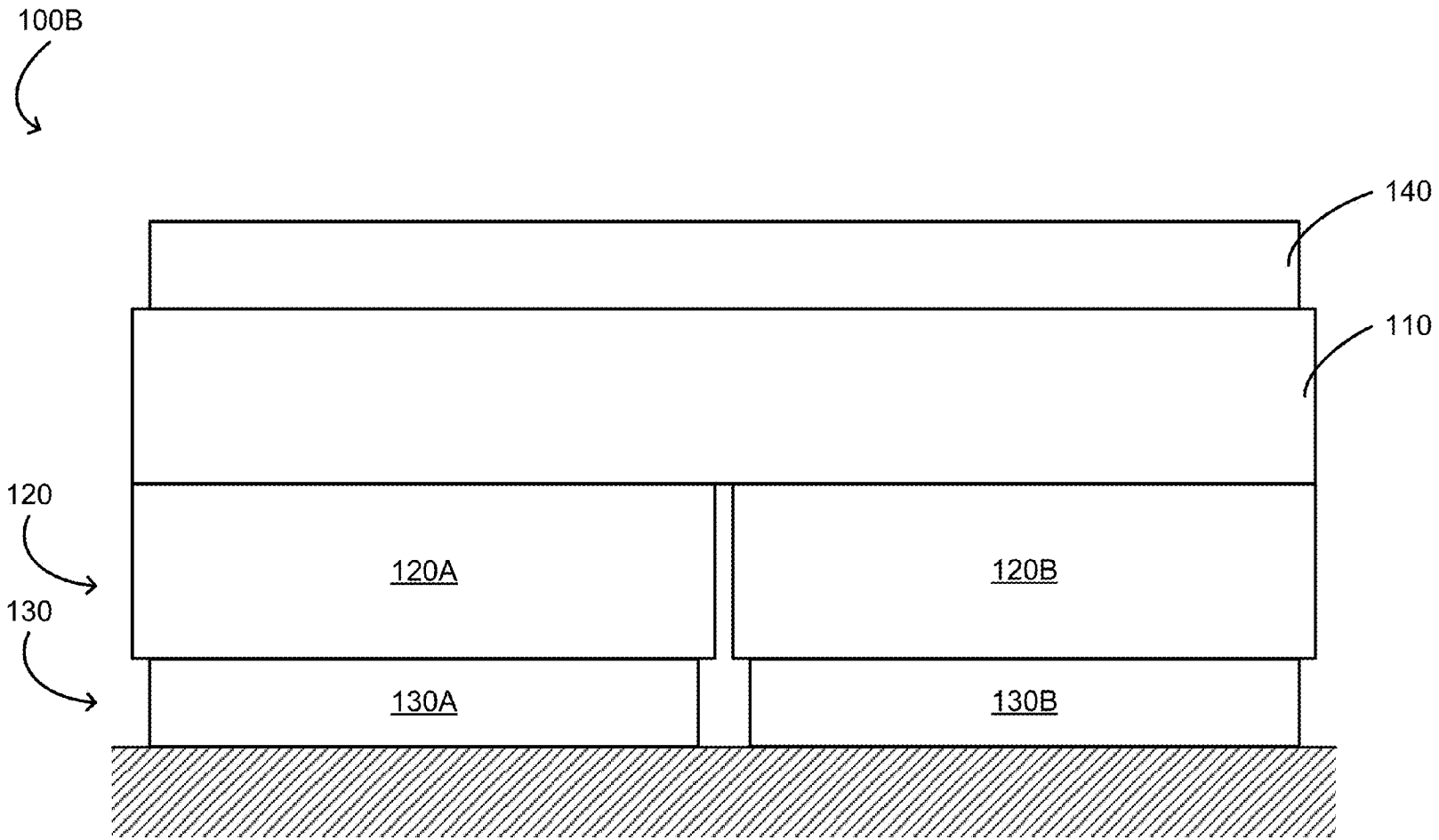

FIG. 1B provides a schematic of an apparatus in accordance with some embodiments.

Figure 1C:
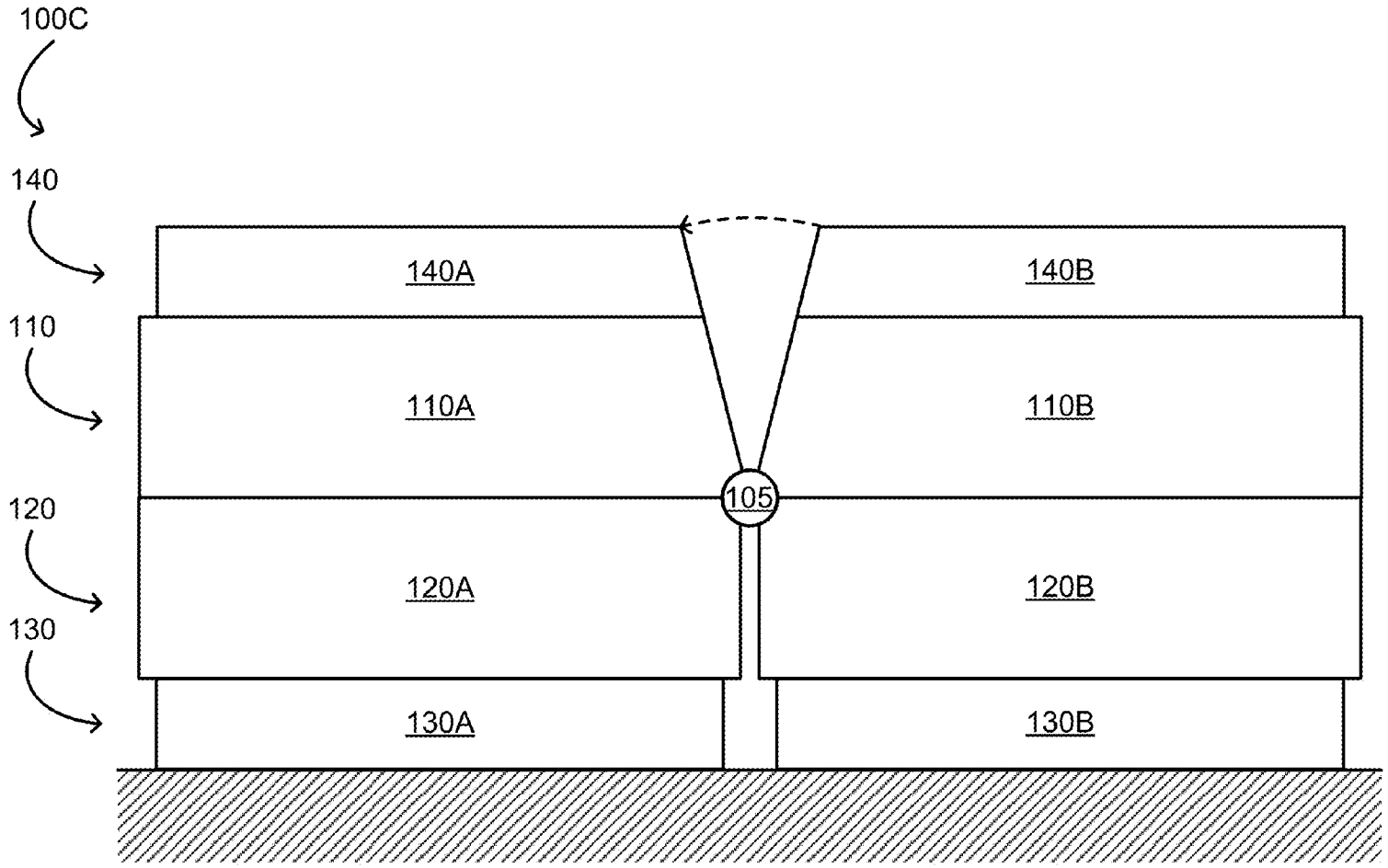

FIG. 1C provides a schematic of an apparatus in accordance with some embodiments.

Figure 1D:
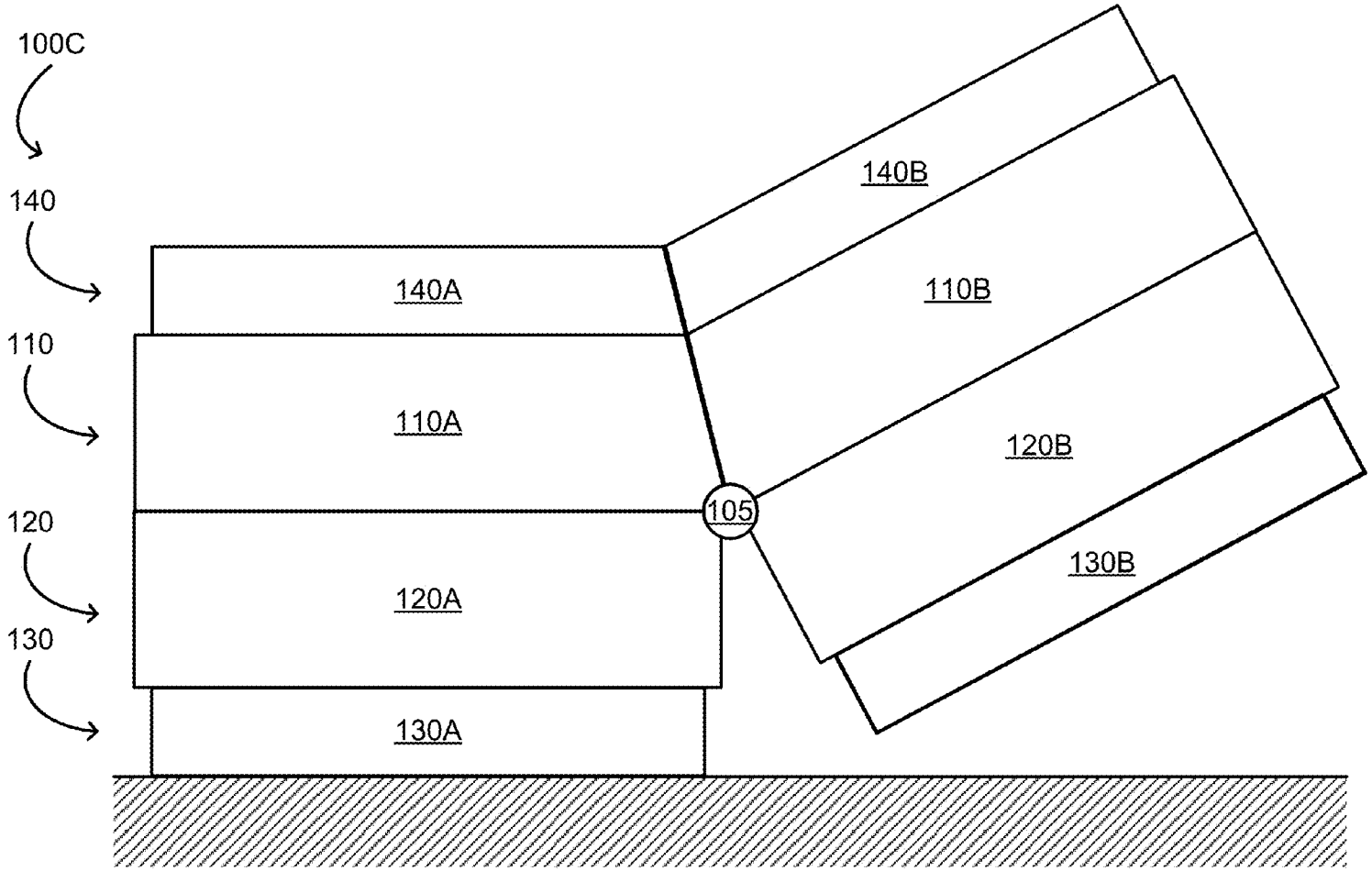

FIG. 1D provides another schematic of the apparatus of FIG. 1C in accordance with some embodiments.

Figure 2A:
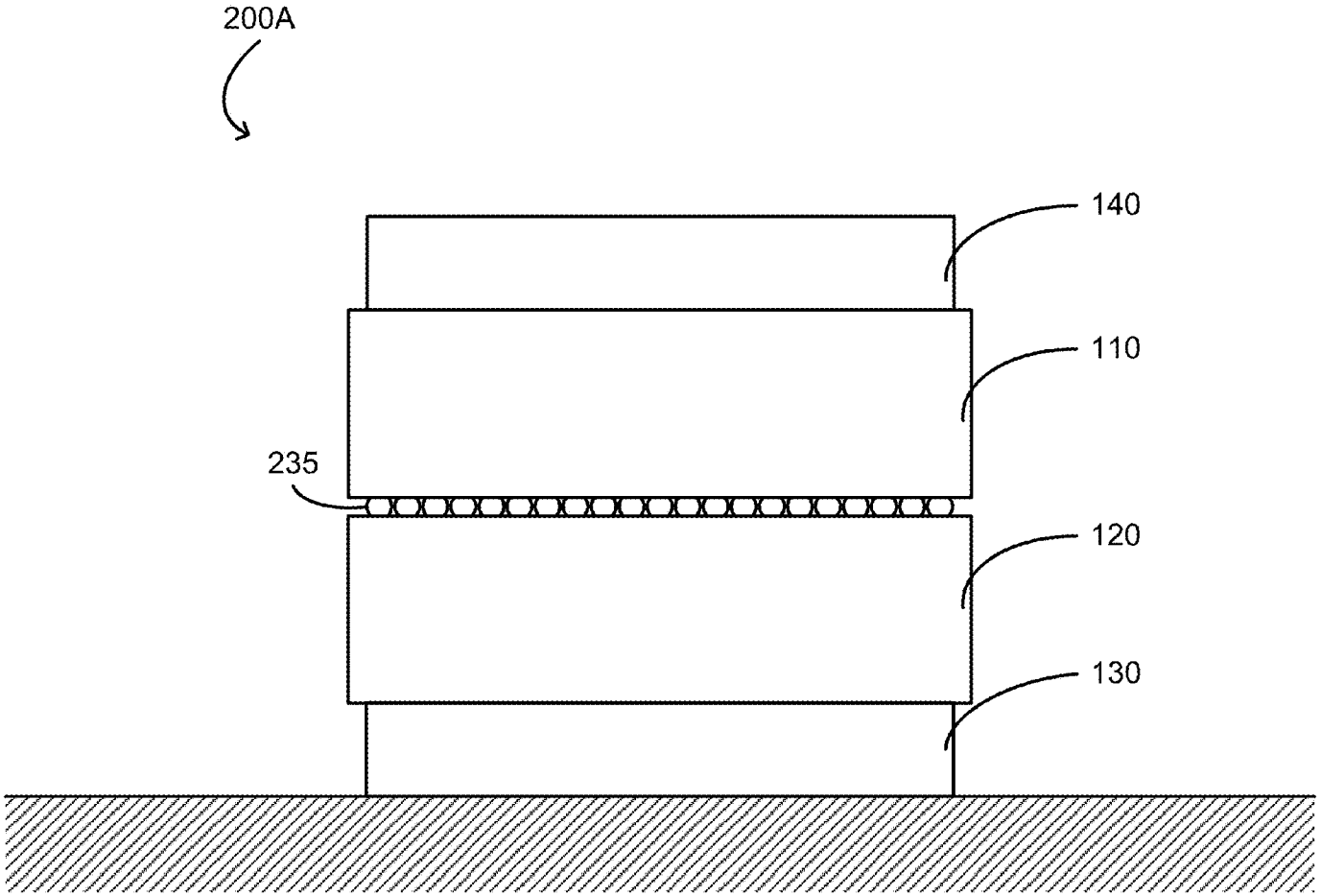

FIG. 2A provides a schematic of an apparatus including a lazy Susan or turntable bearing in accordance with some embodiments.

Figure 2B:
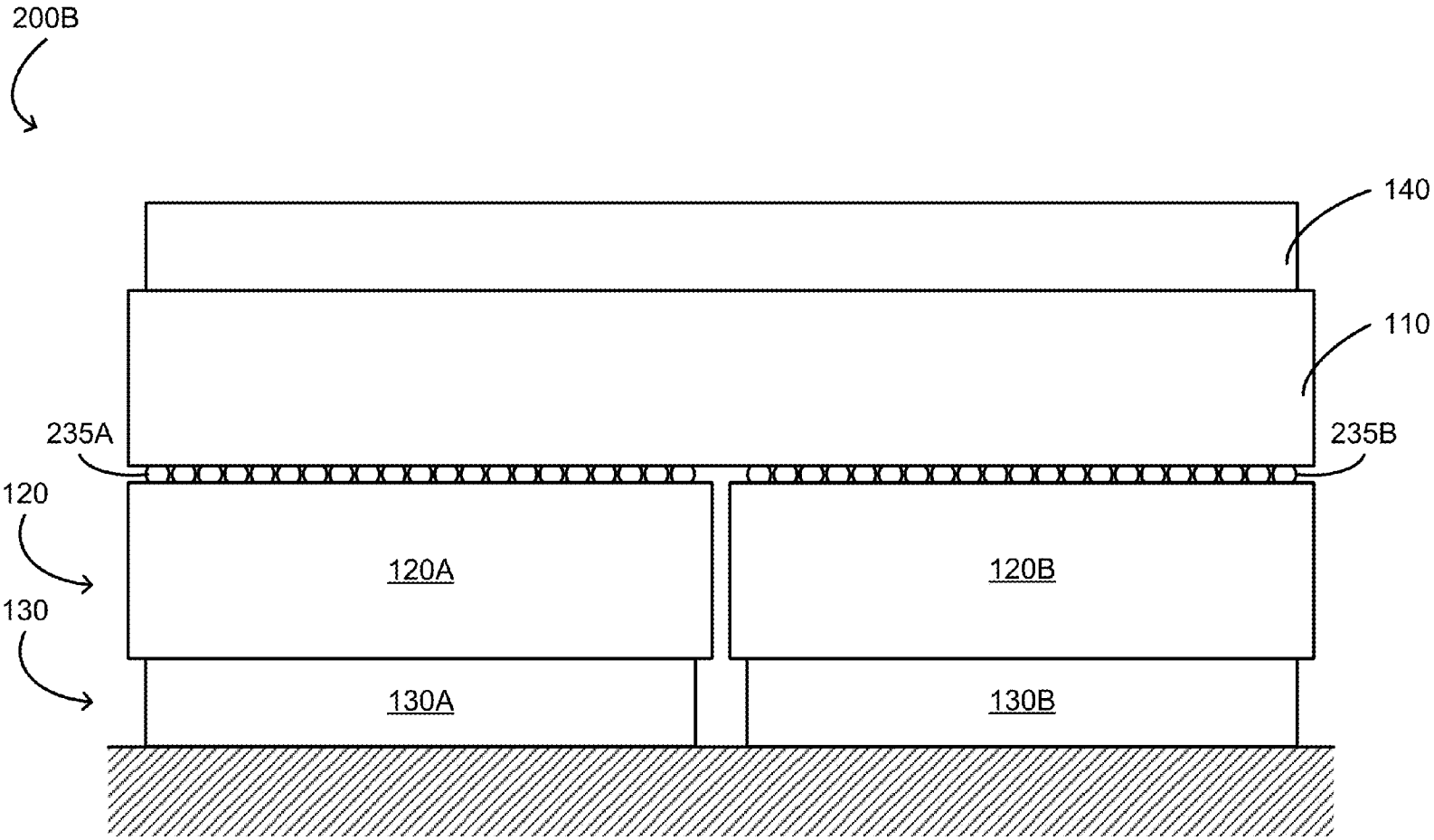

FIG. 2B provides a schematic of an apparatus including a lazy Susan or turntable bearing in accordance with some embodiments.

Figure 2C:
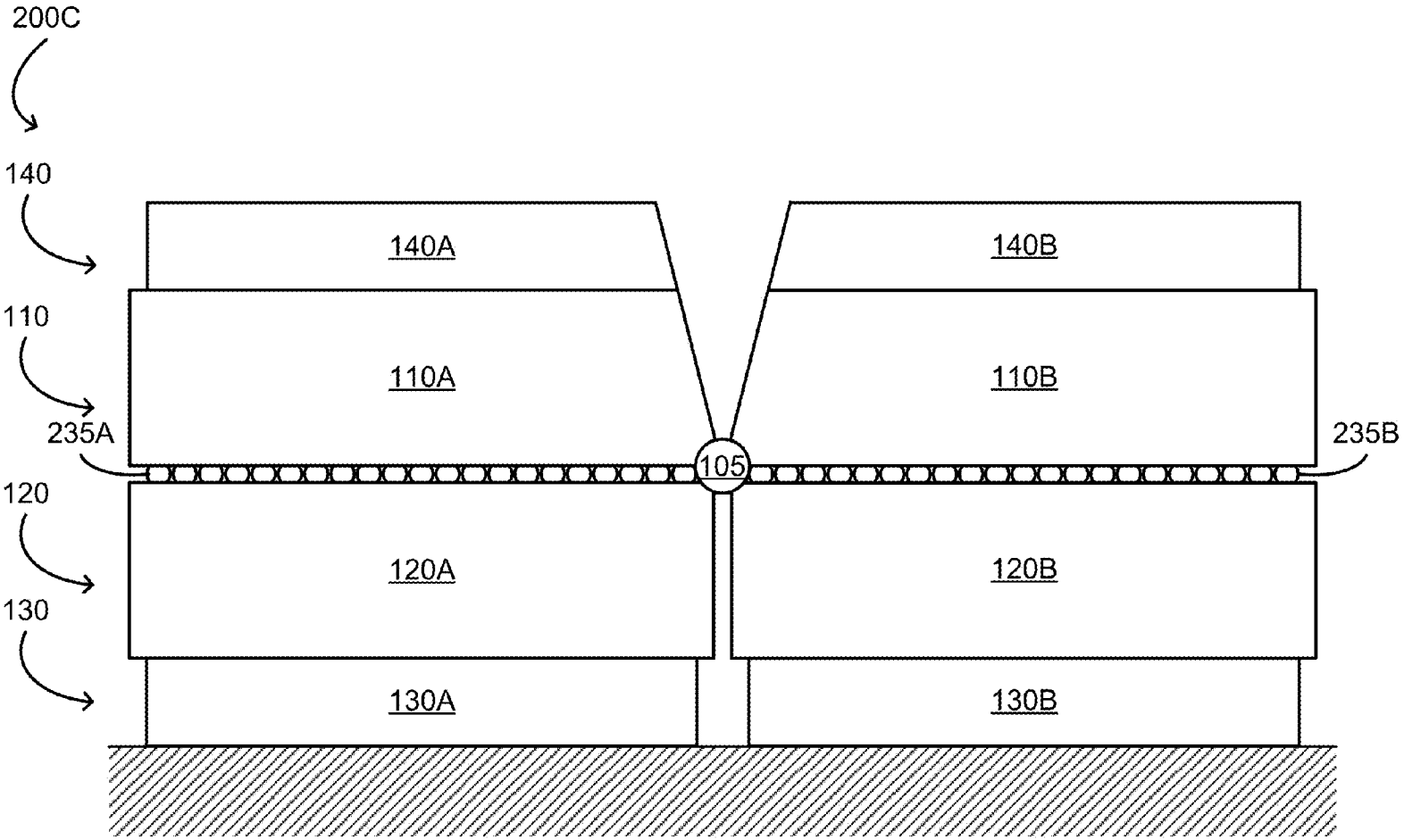

FIG. 2C provides a schematic of an apparatus including a lazy Susan or turntable bearing in accordance with some embodiments.

Figure 3:
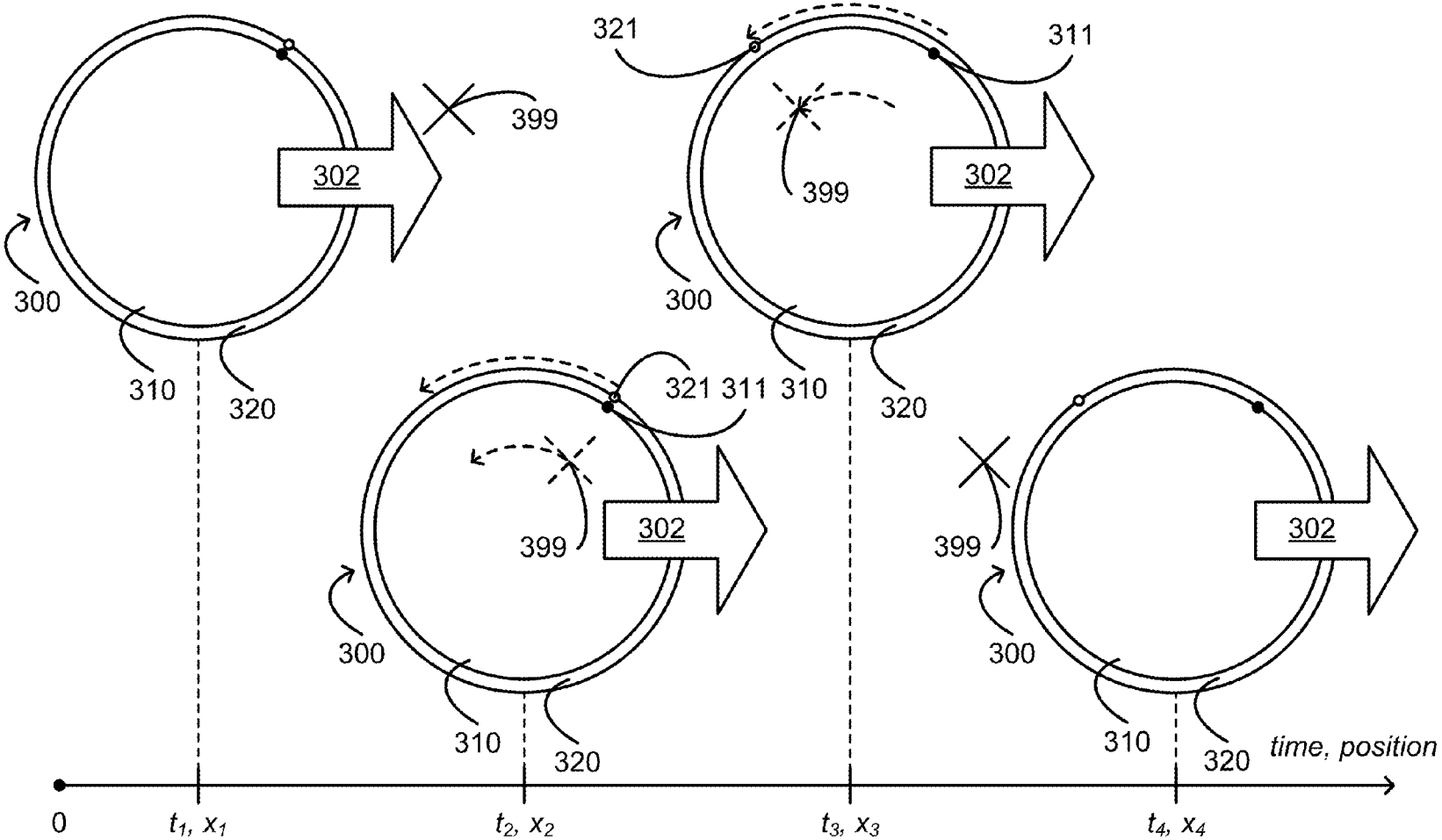

FIG. 3 provides a schematic of an apparatus compensating for a point of lock up in accordance with some embodiments.

Figure 4A:
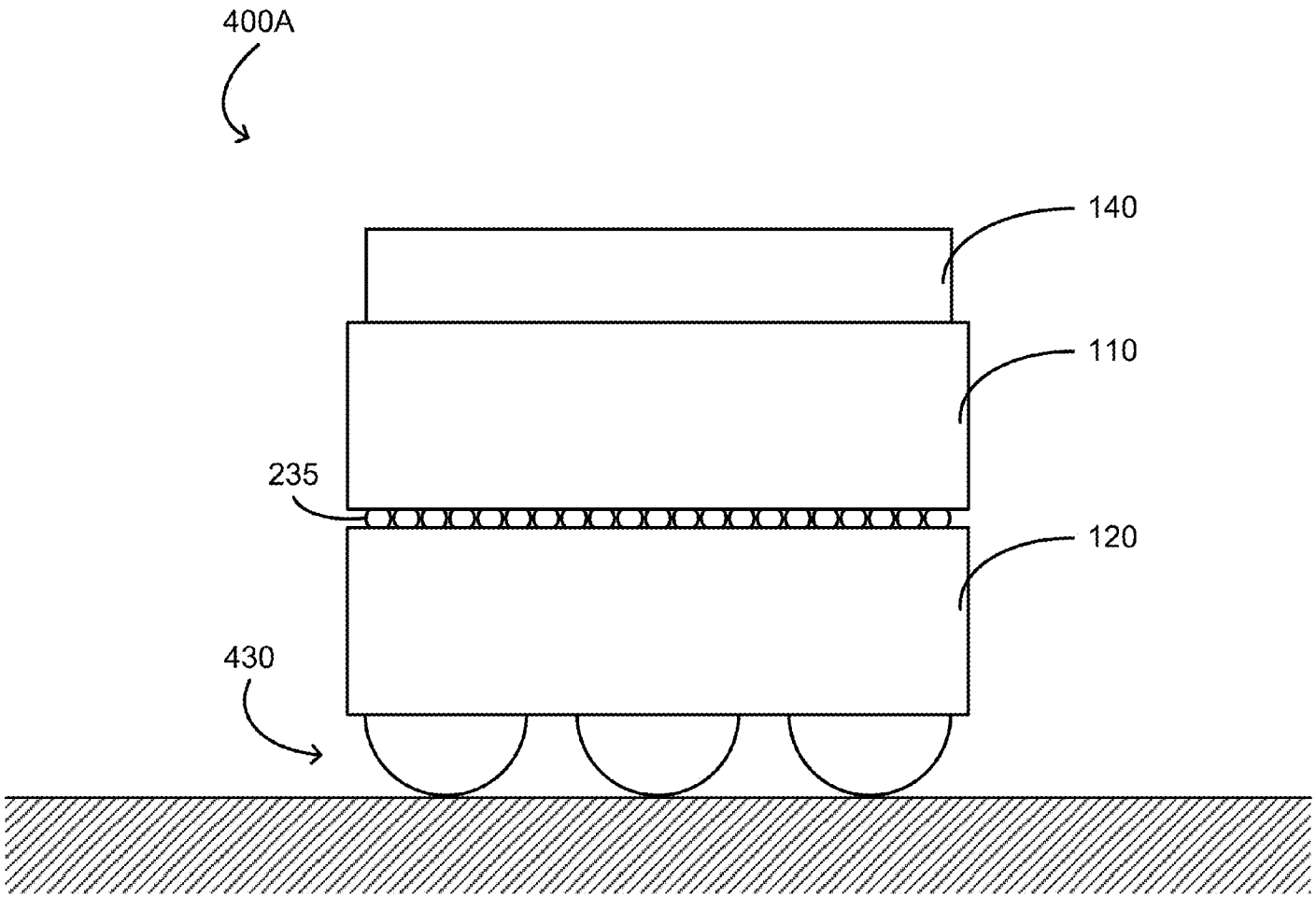

FIG. 4A provides a schematic of an apparatus including a rolling mechanism in accordance with some embodiments.

Figure 4B:
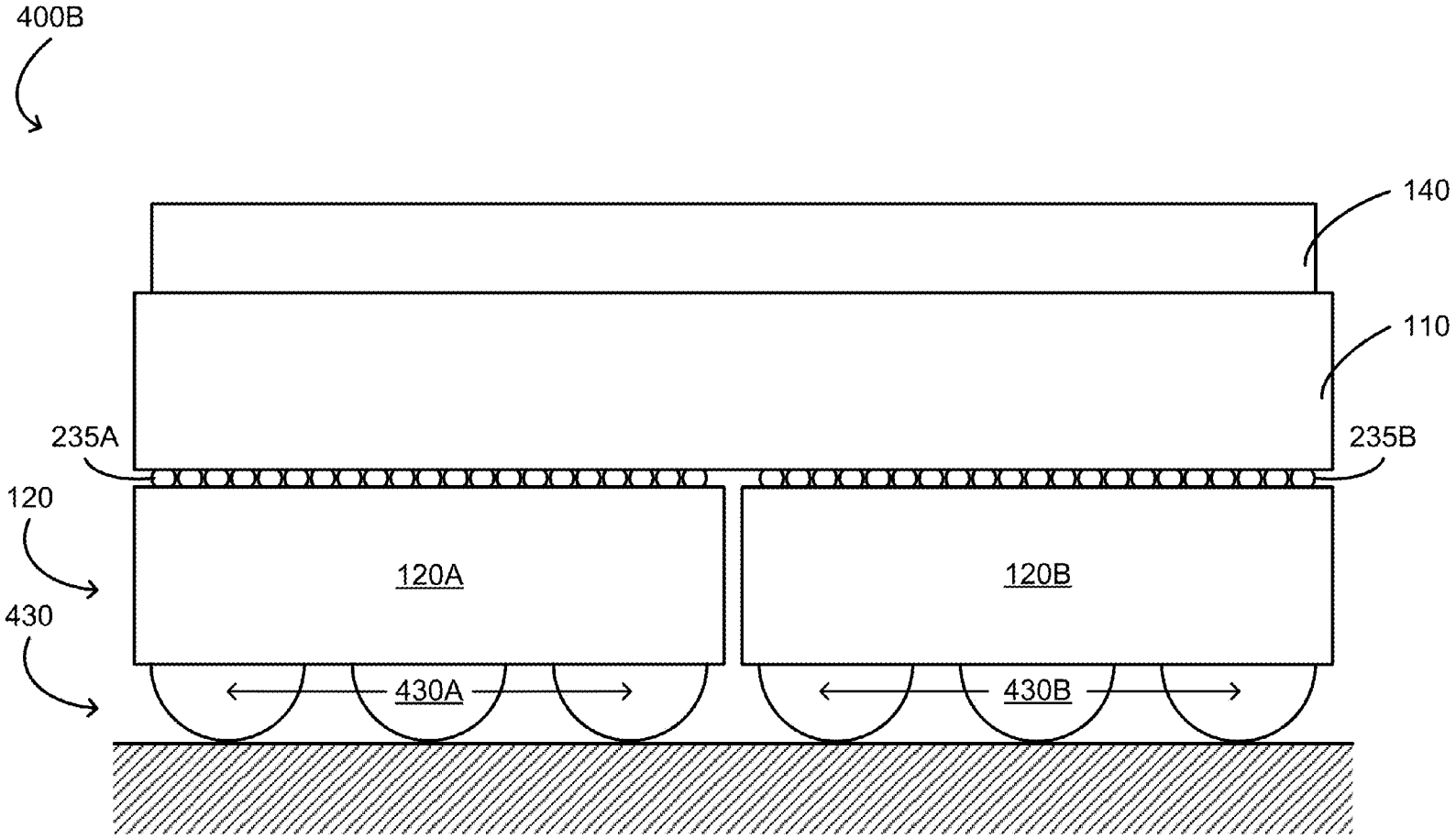

FIG. 4B provides a schematic of an apparatus including a rolling mechanism in accordance with some embodiments.

Figure 4C:
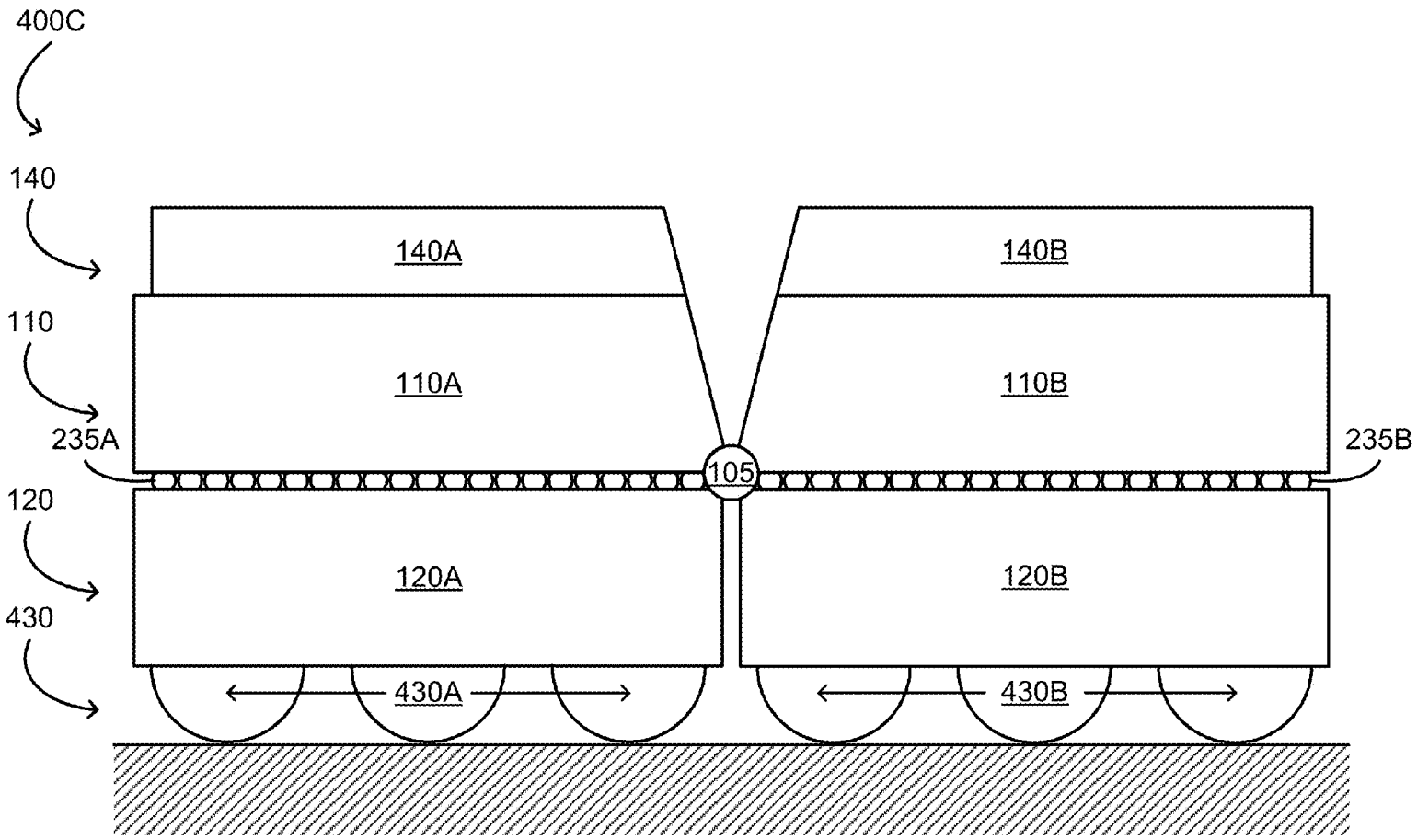

FIG. 4C provides a schematic of an apparatus including a rolling mechanism in accordance with some embodiments.

Figure 5:
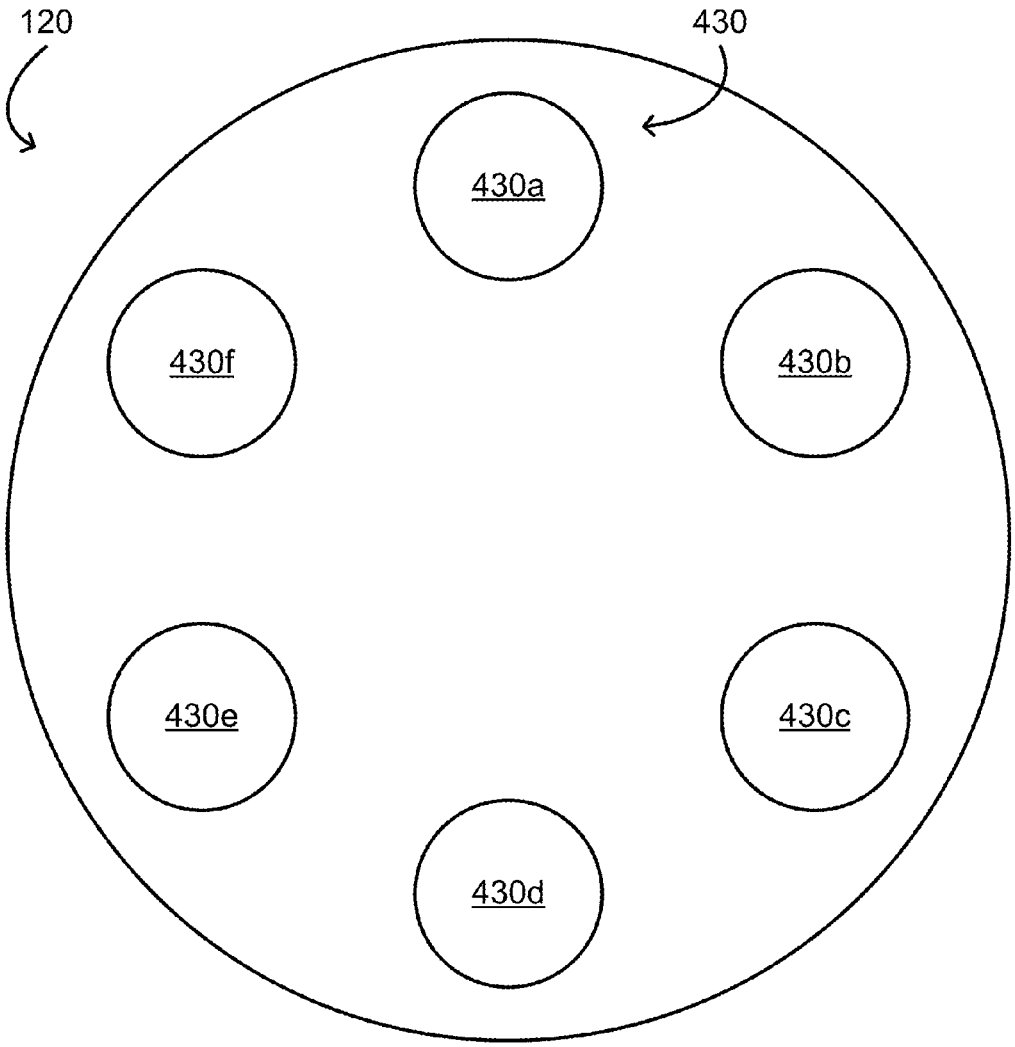

FIG. 5 provides a schematic of a rolling mechanism in accordance with some embodiments.

Figure 6A:
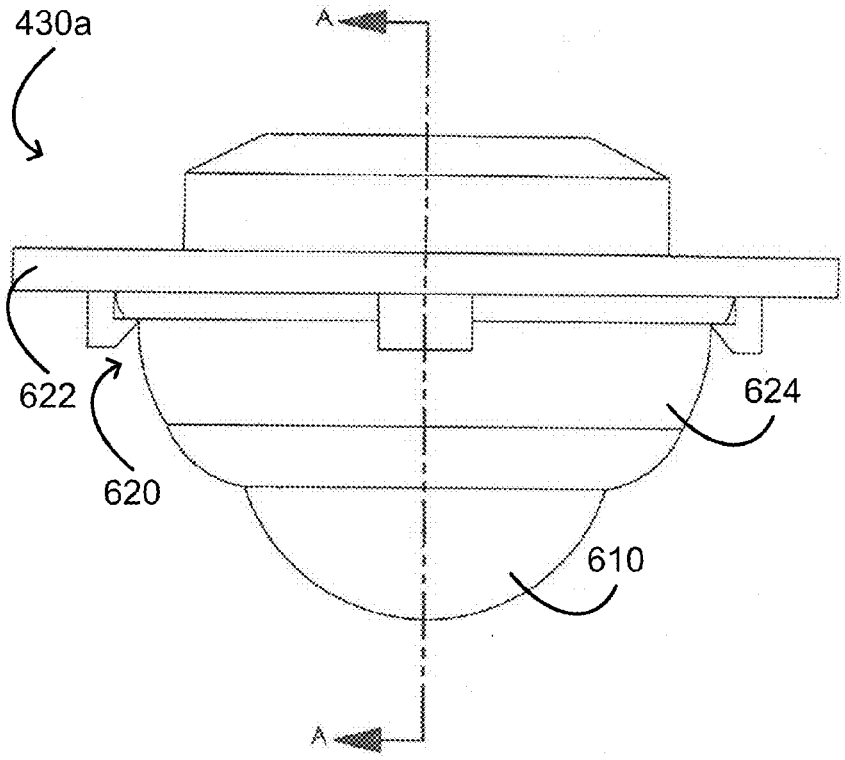

FIG. 6A provides a schematic of a ball transfer bearing in accordance with some embodiments.

Figure 6B:
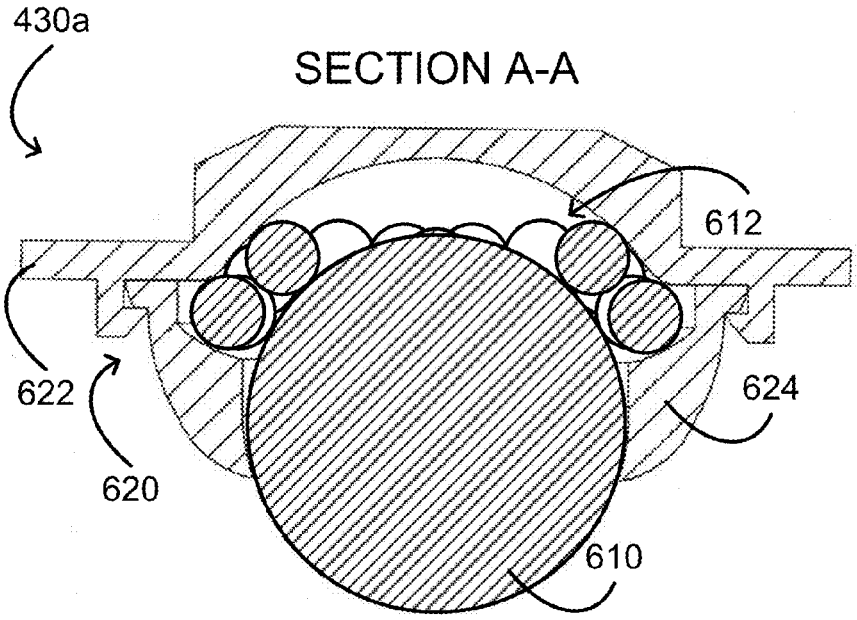

FIG. 6B provides a schematic of a ball transfer bearing in accordance with some embodiments.

Figure 7:
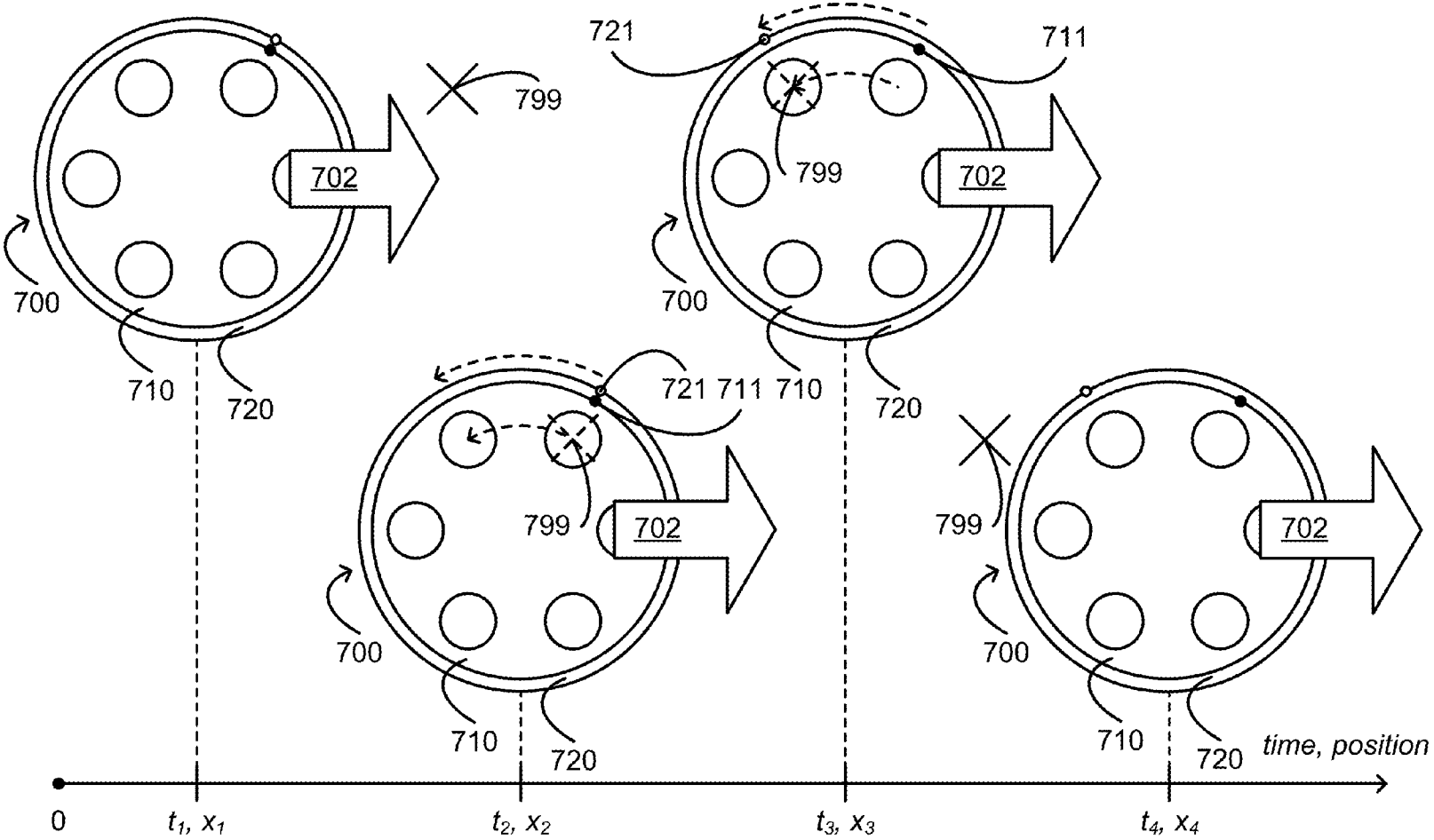

FIG. 7 provides a schematic of an apparatus compensating for a point of lock up in accordance with some embodiments.

Figure 8A:
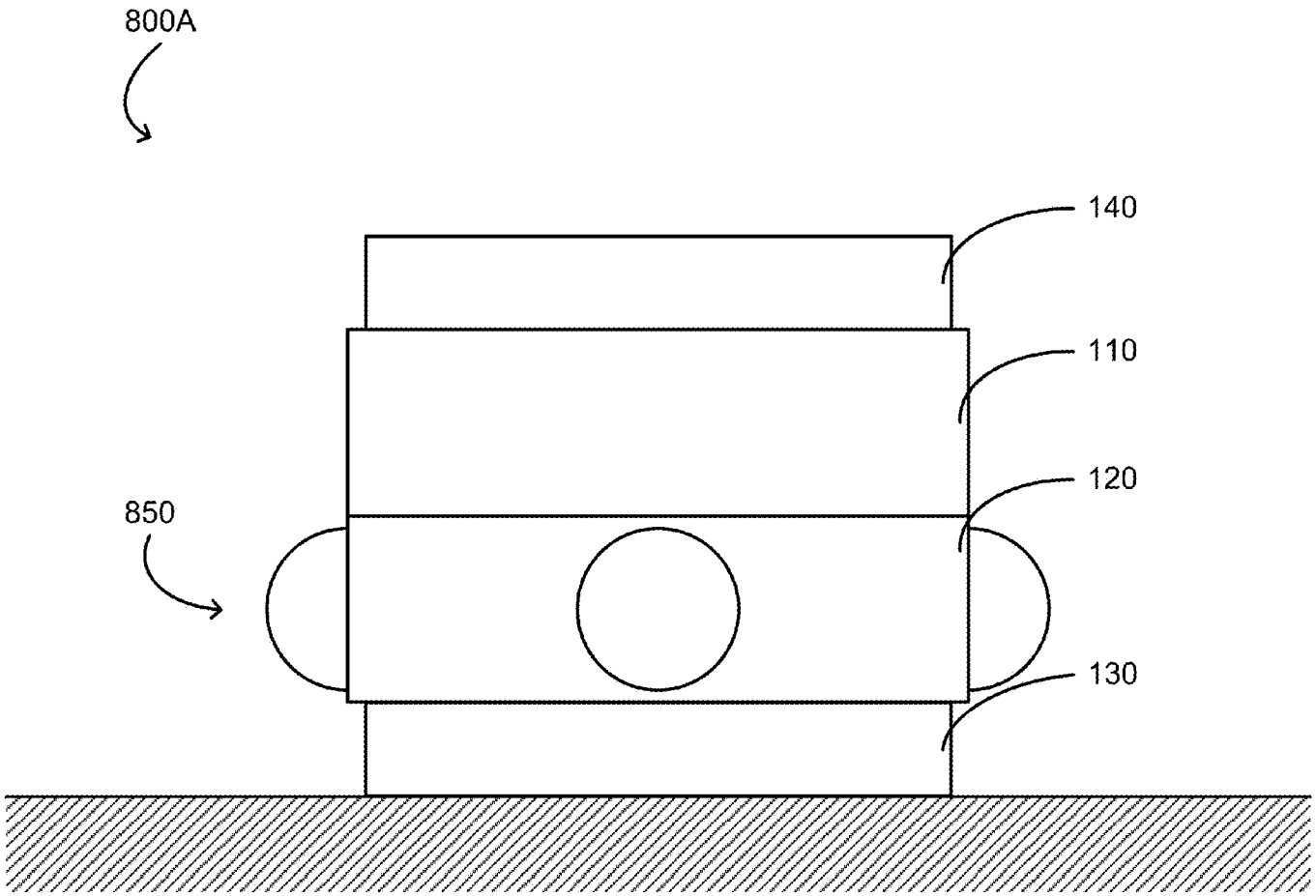

FIG. 8A provides a schematic of an apparatus including a side-mounted rolling mechanism in accordance with some embodiments.

Figure 8B:
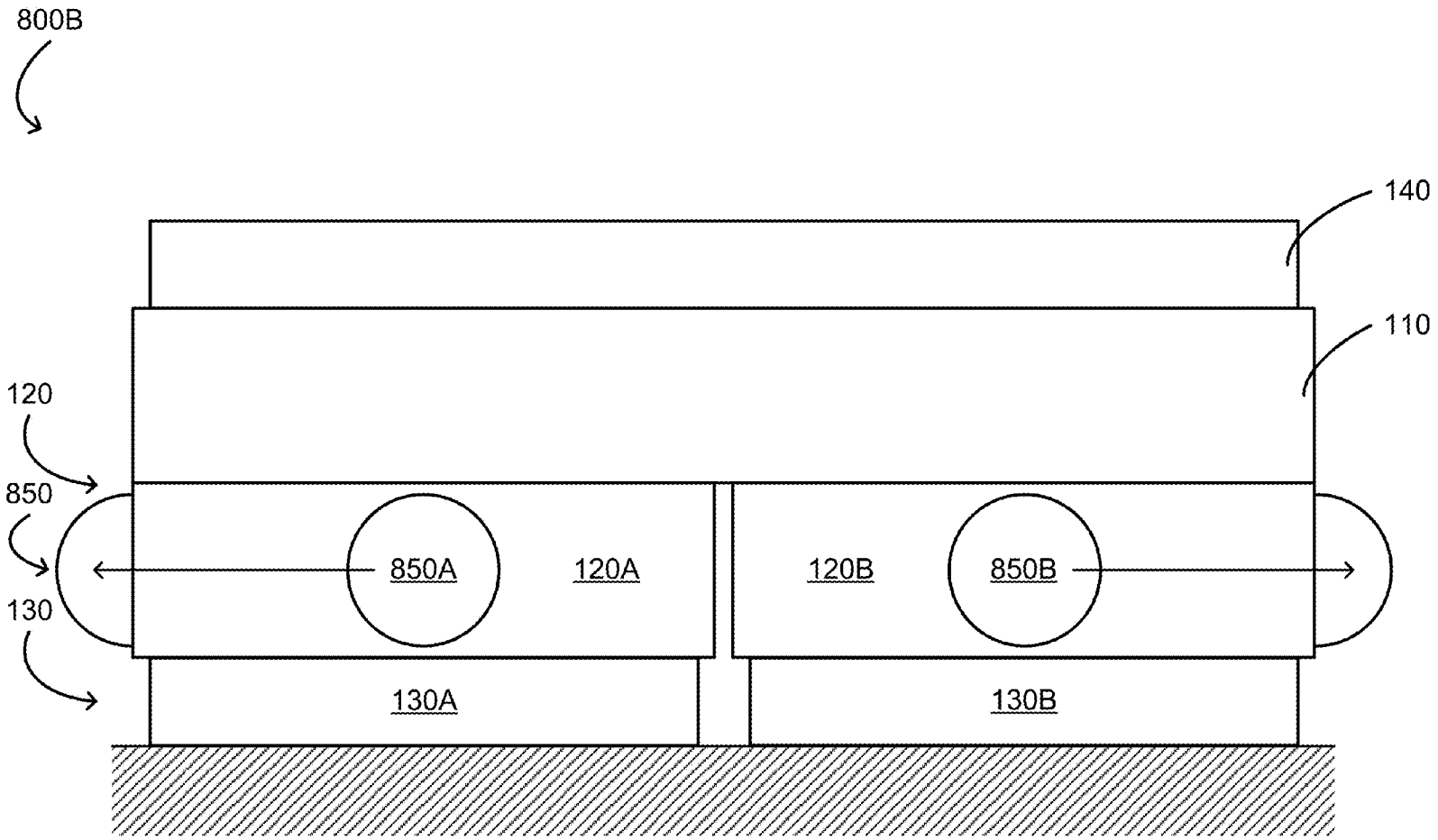

FIG. 8B provides a schematic of an apparatus including a side-mounted rolling mechanism in accordance with some embodiments.

Figure 8C:
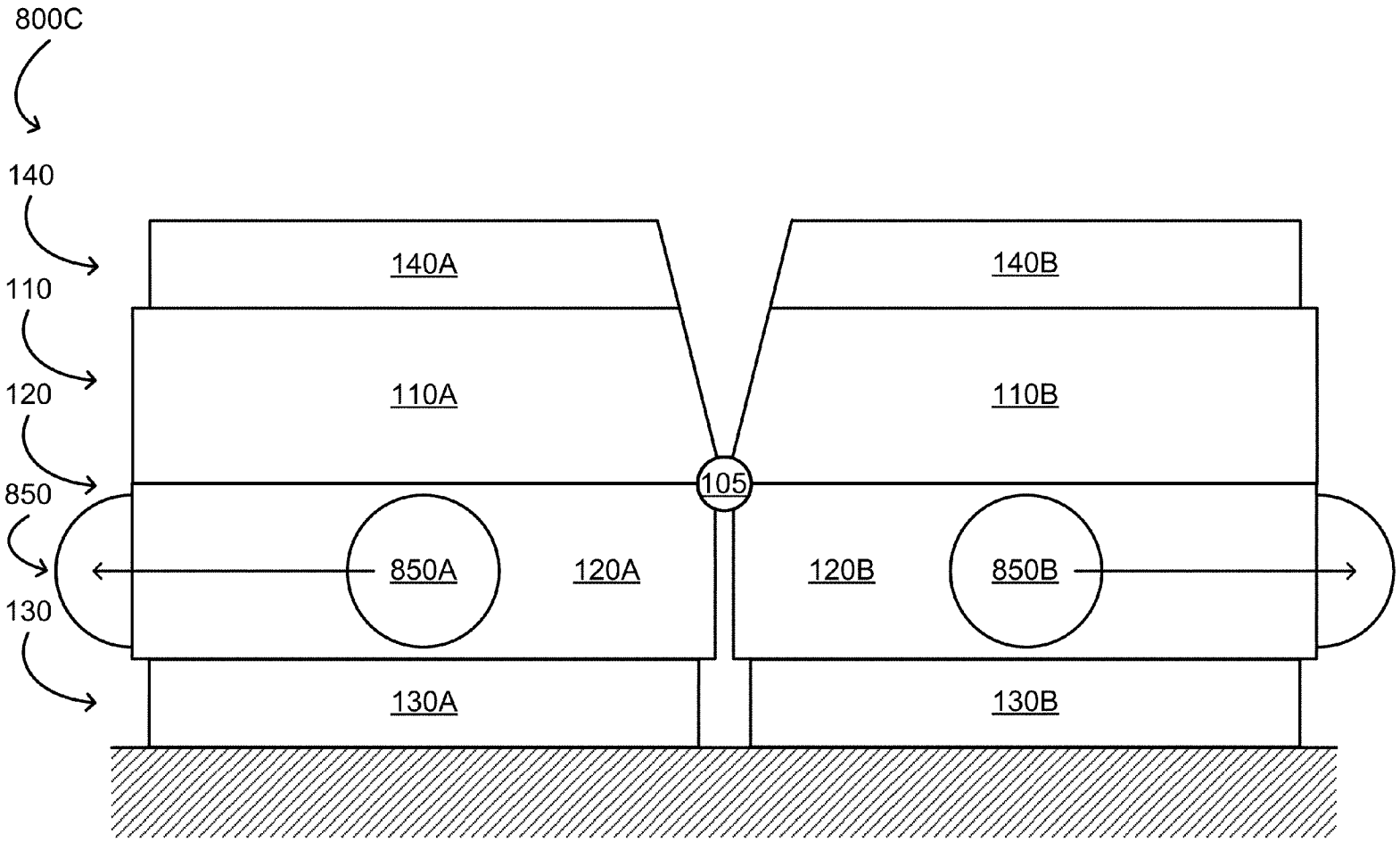

FIG. 8C provides a schematic of an apparatus including a side-mounted rolling mechanism in accordance with some embodiments.

Figure 9:
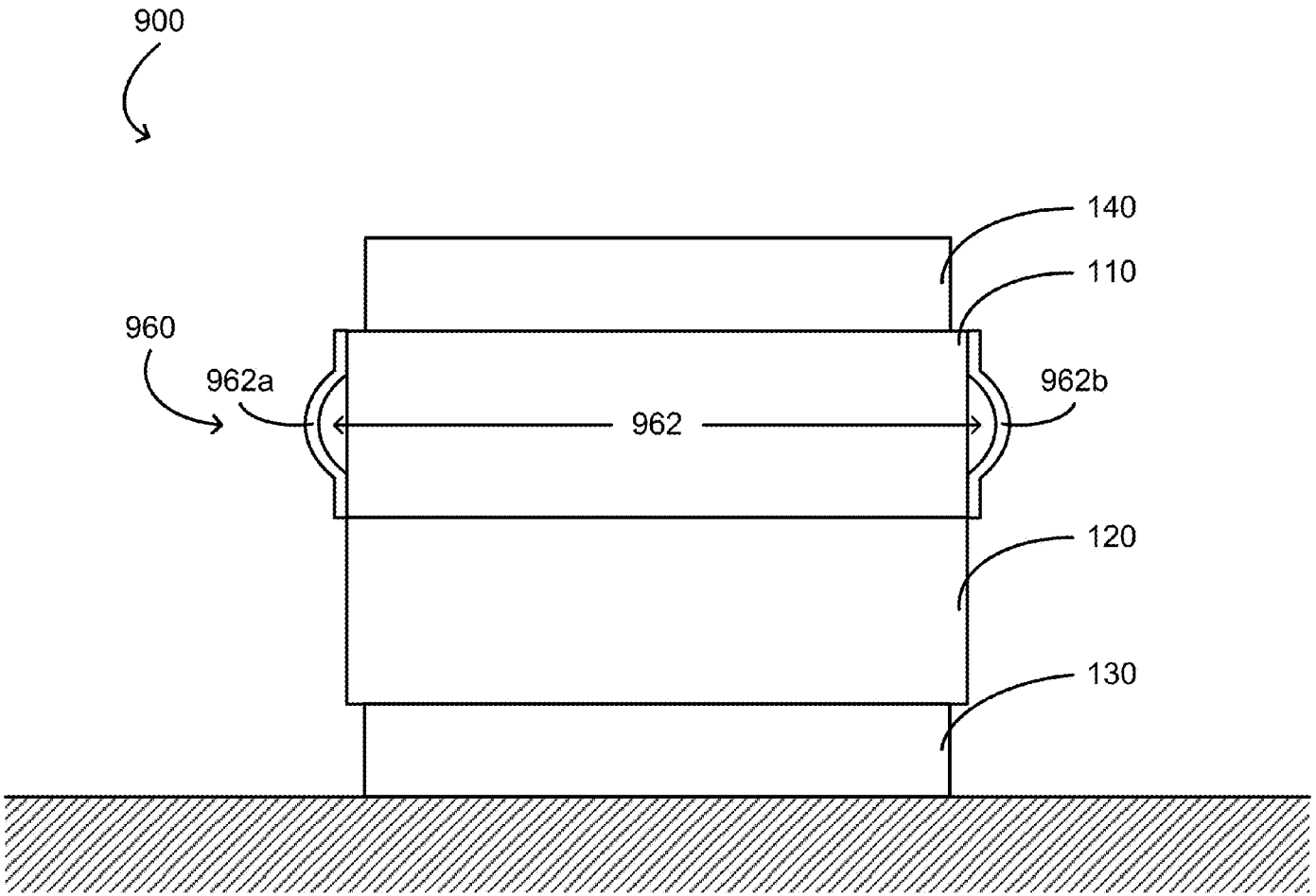

FIG. 9 provides a schematic of an apparatus including a resistance band-attaching means in accordance with some embodiments.

Figure 10A:
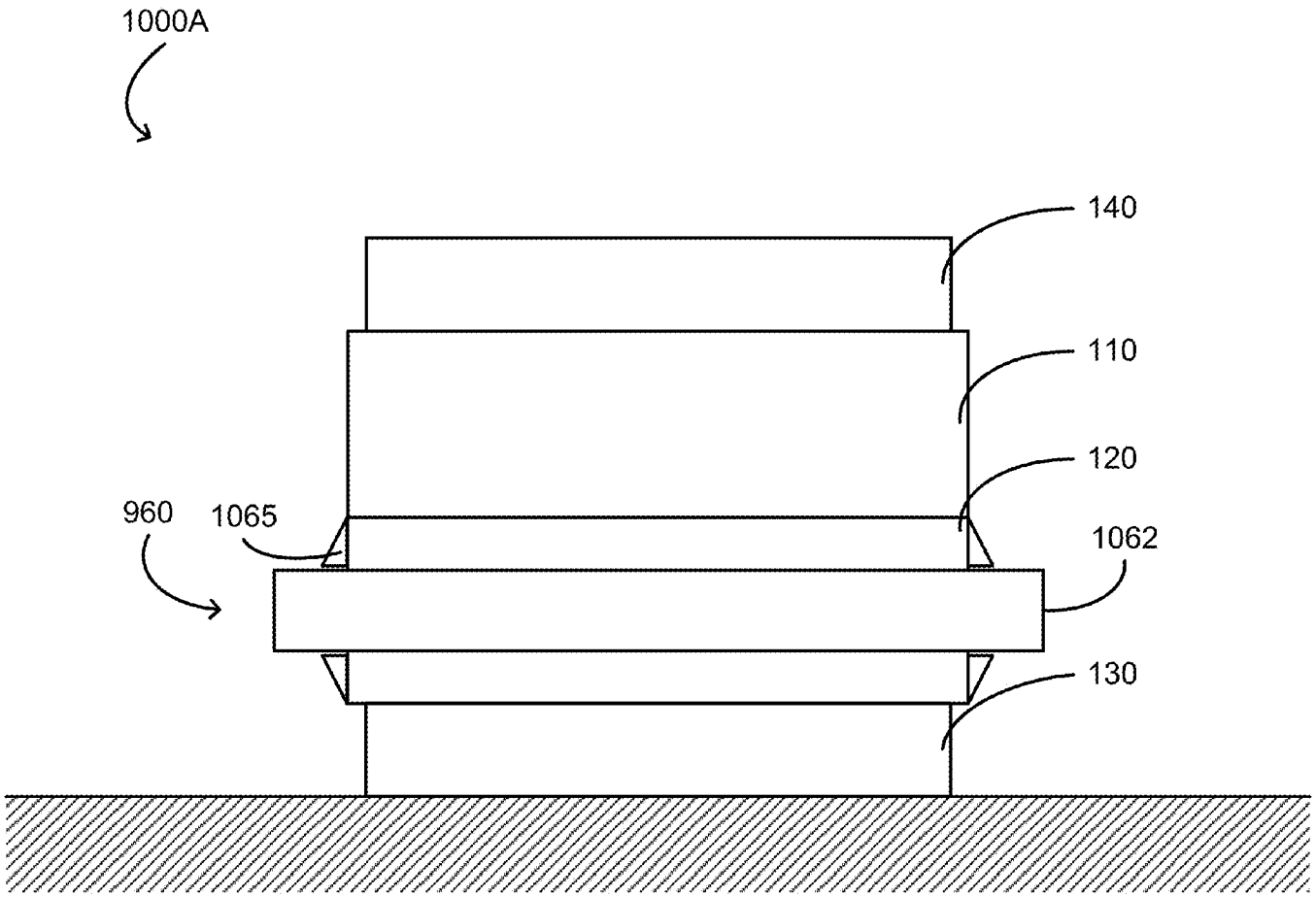

FIG. 10A provides a schematic of an apparatus including a resistance band-attaching means in accordance with some embodiments.

Figure 10B:
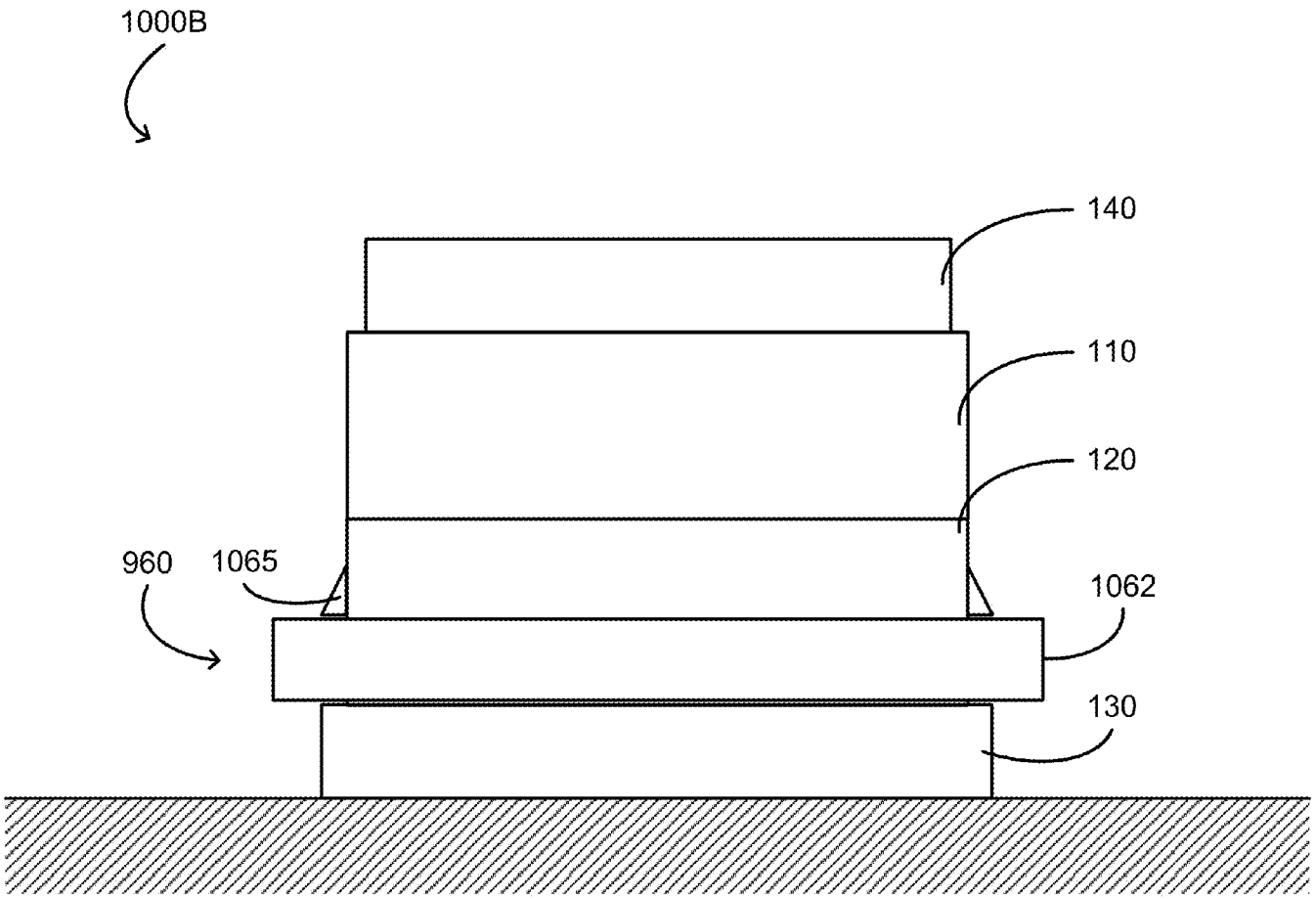

FIG. 10B provides a schematic of an apparatus including a resistance band-attaching means in accordance with some embodiments.

Figure 10C:
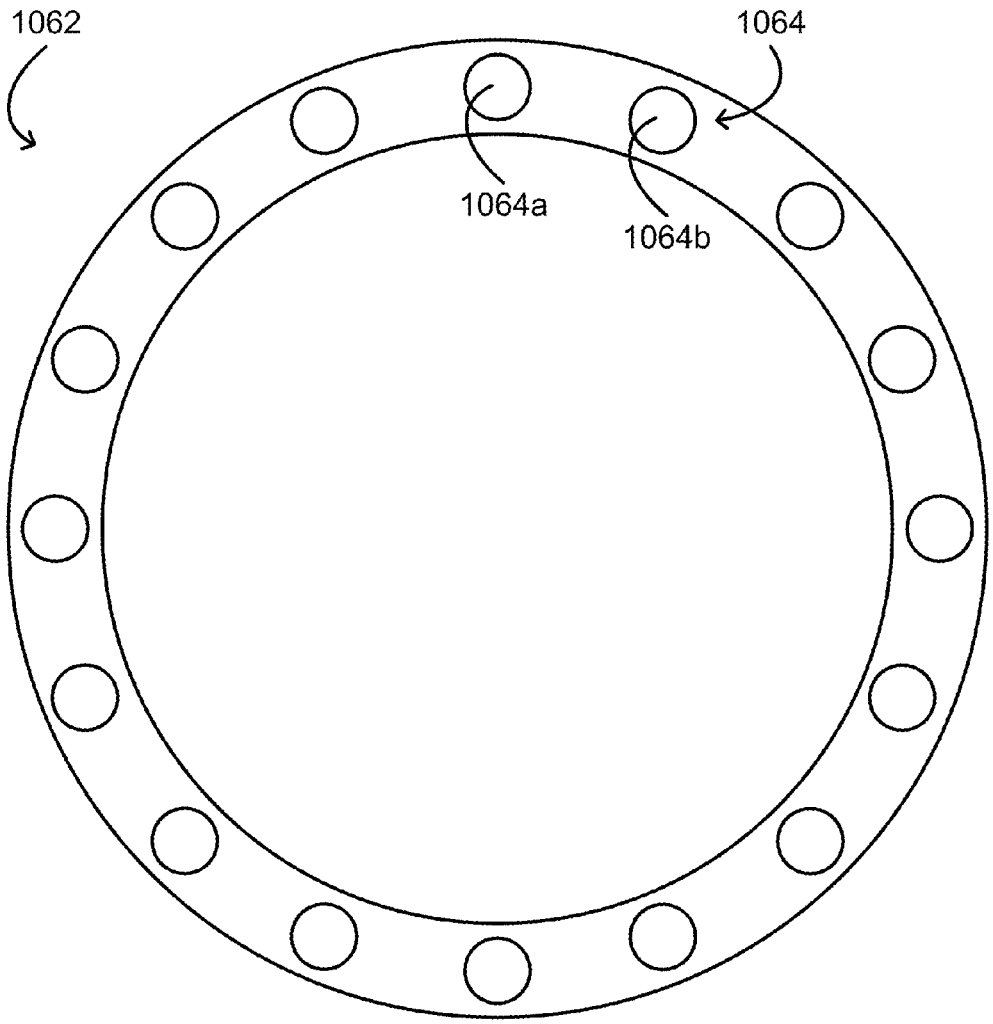

FIG. 10C provides a schematic of a ring for a resistance band-attaching means in accordance with some embodiments.

Figure 11:
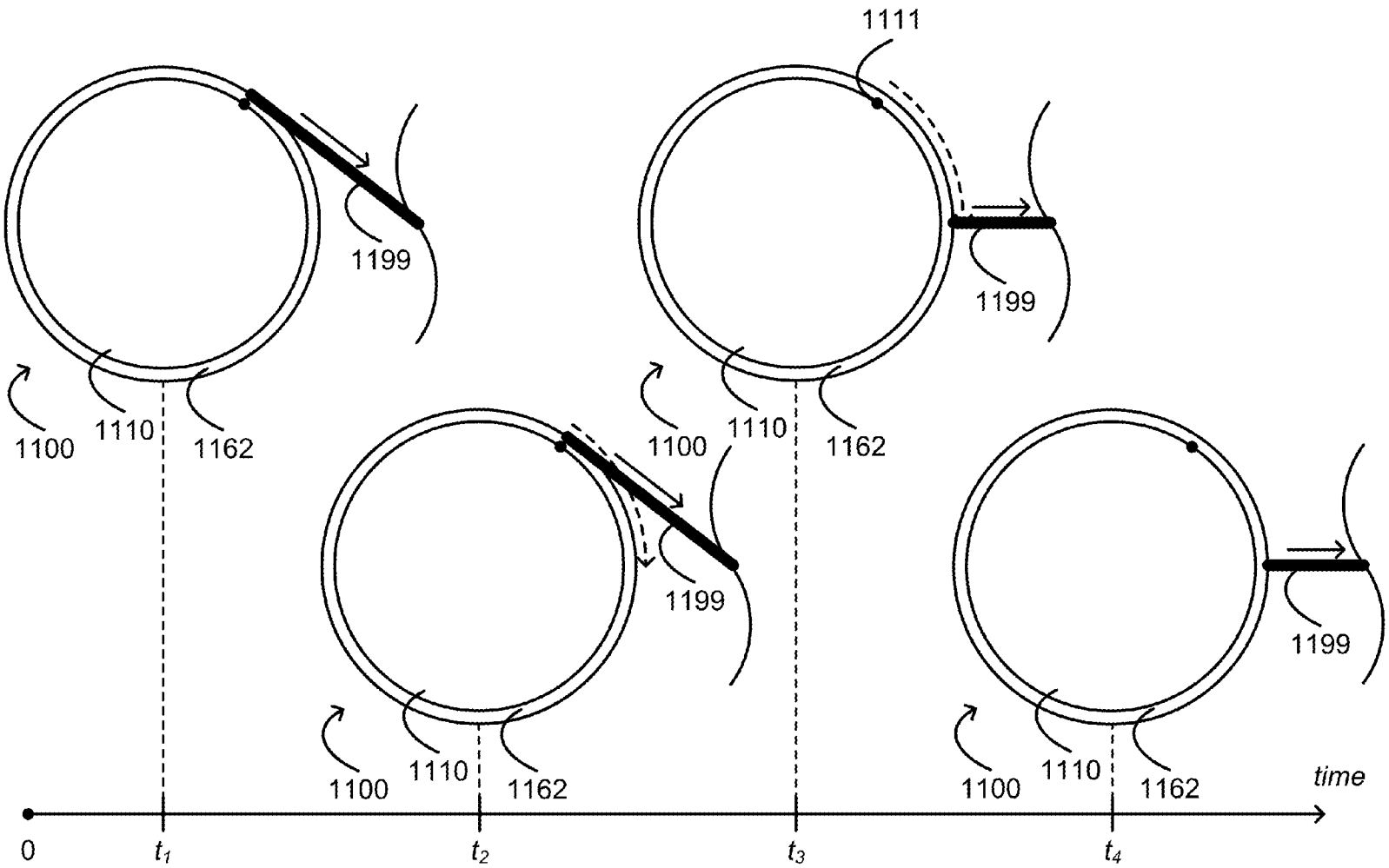

FIG. 11 provides a schematic of an apparatus adjusting to an applied resistance band-pulling force in accordance with some embodiments.

Figure 12A:
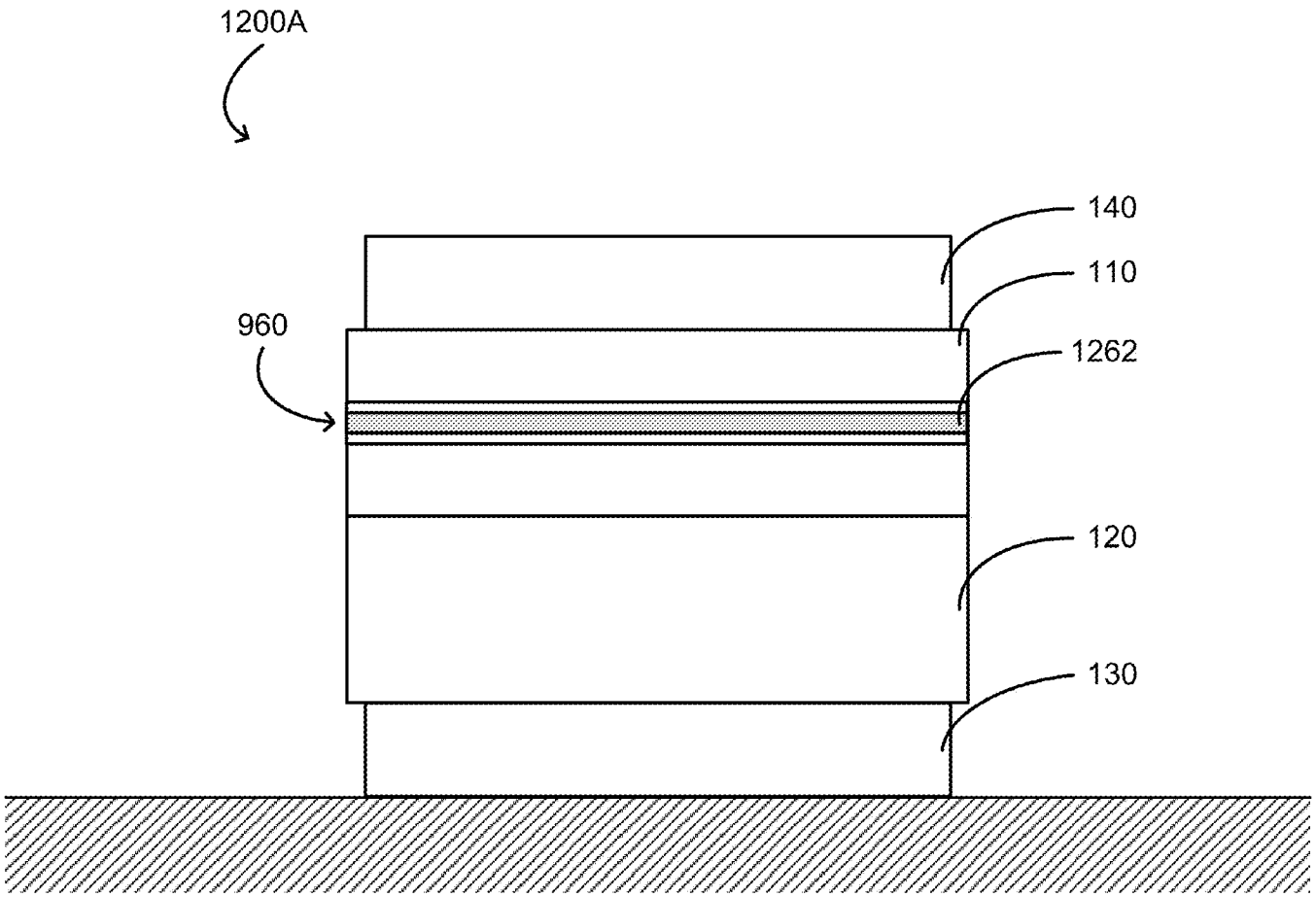

FIG. 12A provides a schematic of an apparatus including a resistance band-attaching means in accordance with some embodiments.

Figure 12B:
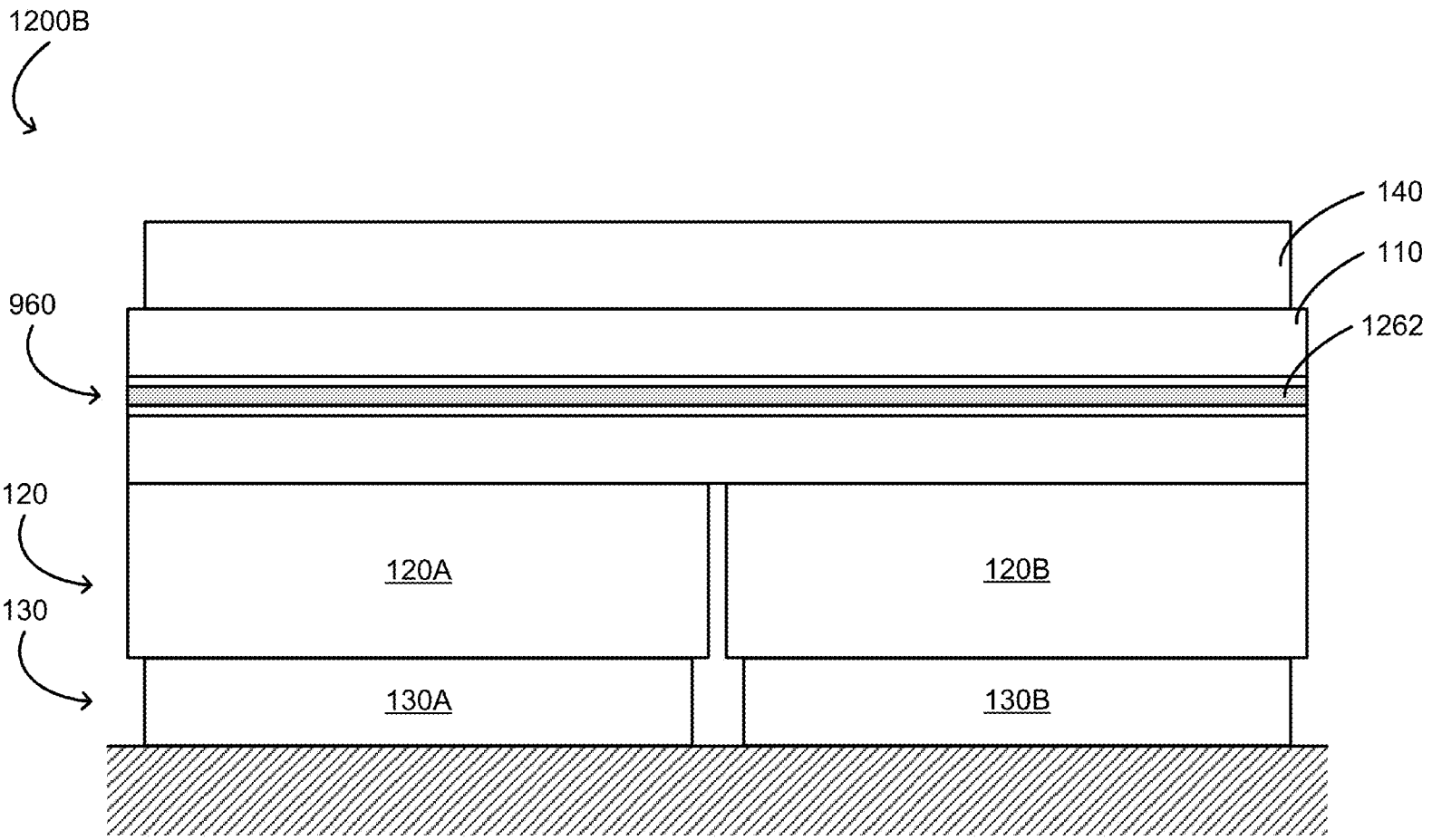

FIG. 12B provides a schematic of an apparatus including a resistance band-attaching means in accordance with some embodiments.

Figure 12C:
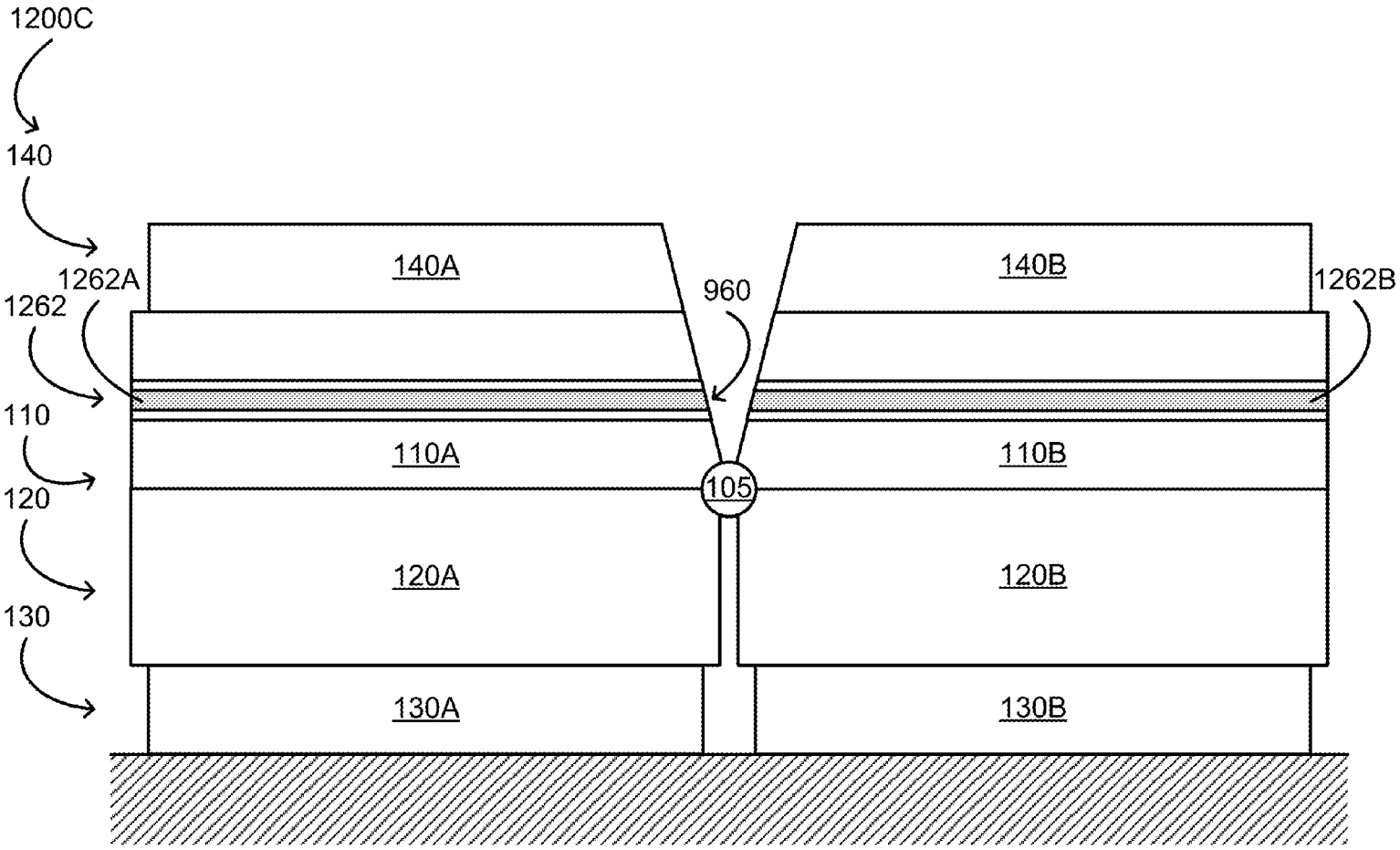

FIG. 12C provides a schematic of an apparatus including a resistance band-attaching means in accordance with some embodiments.

Figures 13A, 13B:
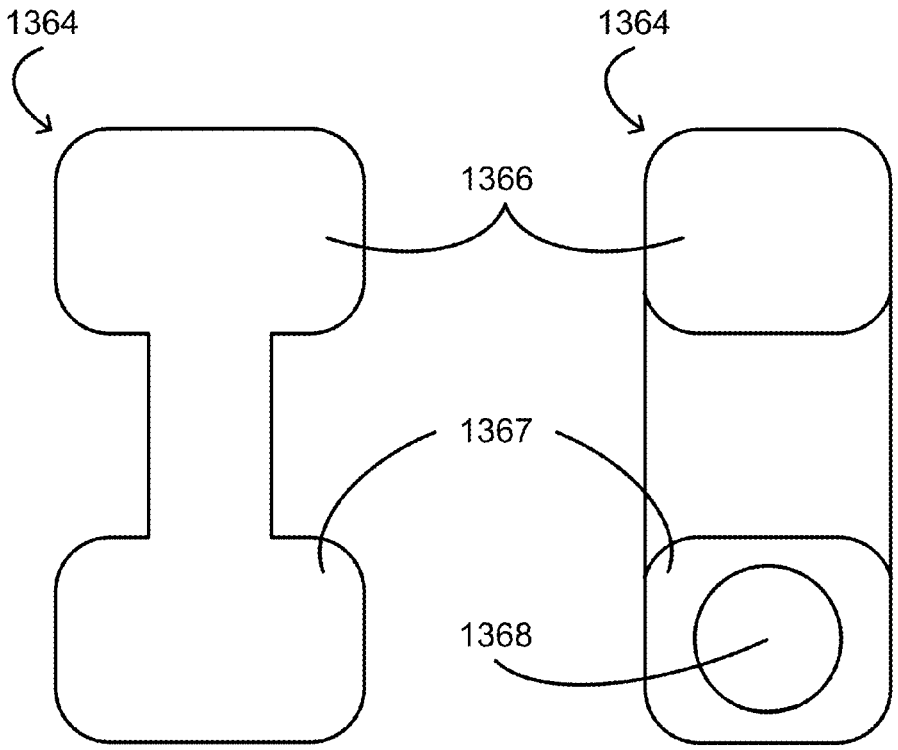

FIG. 13A provides a schematic of a runner for a track-and-runner system in accordance with some embodiments.

FIG. 13B provides a schematic of a runner for a track-and-runner system in accordance with some embodiments.

Figure 13C:
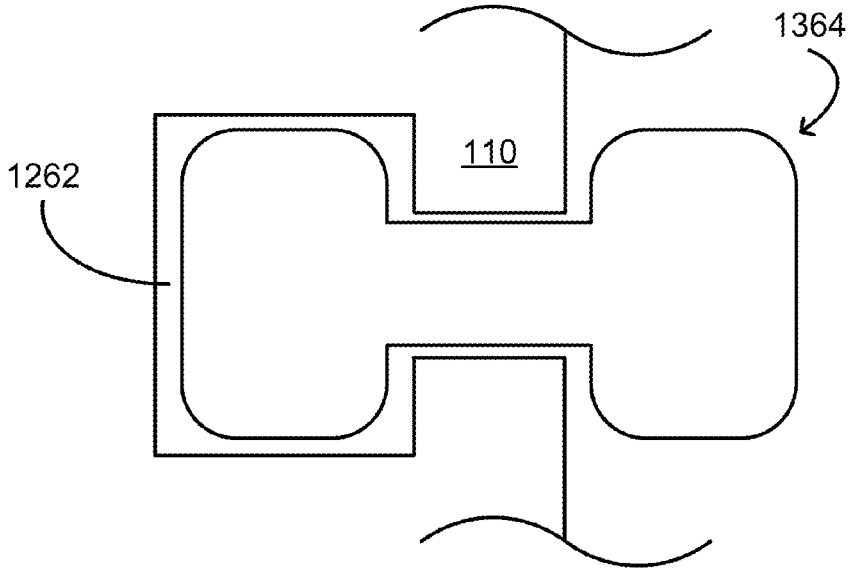

FIG. 13C provides a schematic of a track-and-runner system in accordance with some embodiments.

Figures 14A, 14B:
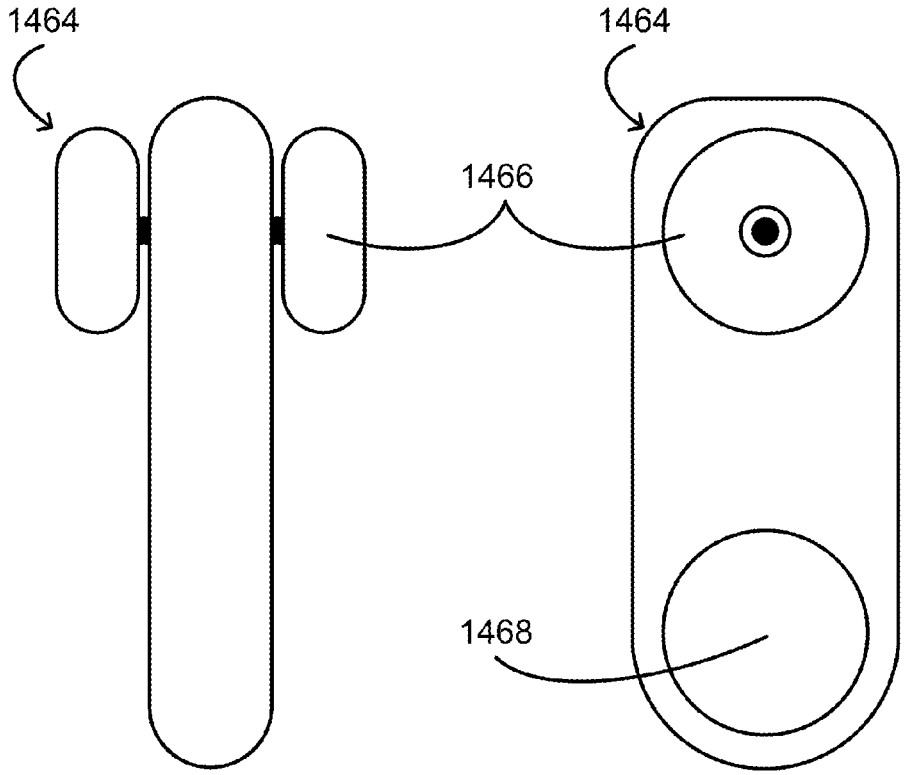

FIG. 14A provides a schematic of a runner for a track-and-runner system in accordance with some embodiments.

FIG. 14B provides a schematic of a runner for a track-and-runner system in accordance with some embodiments.

Figure 14C:
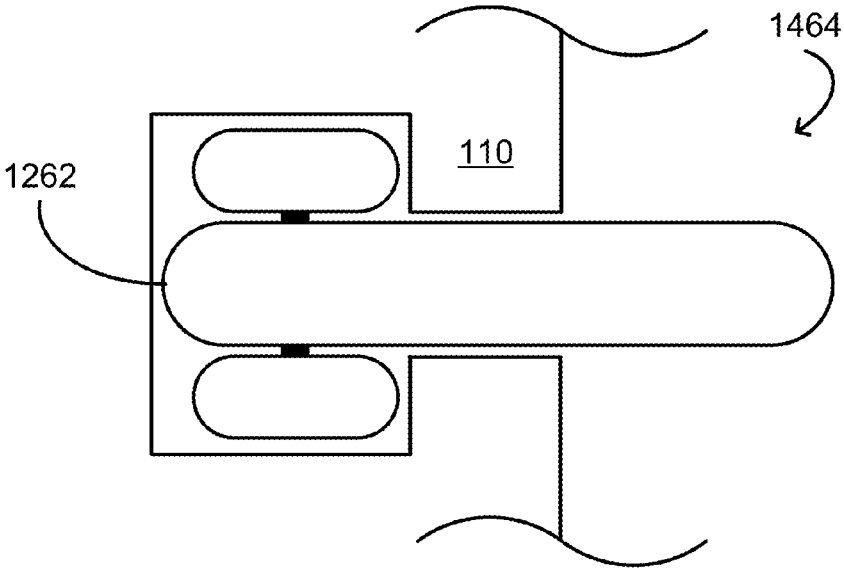

FIG. 14C provides a schematic of a track-and-runner system in accordance with some embodiments.

Figure 15:
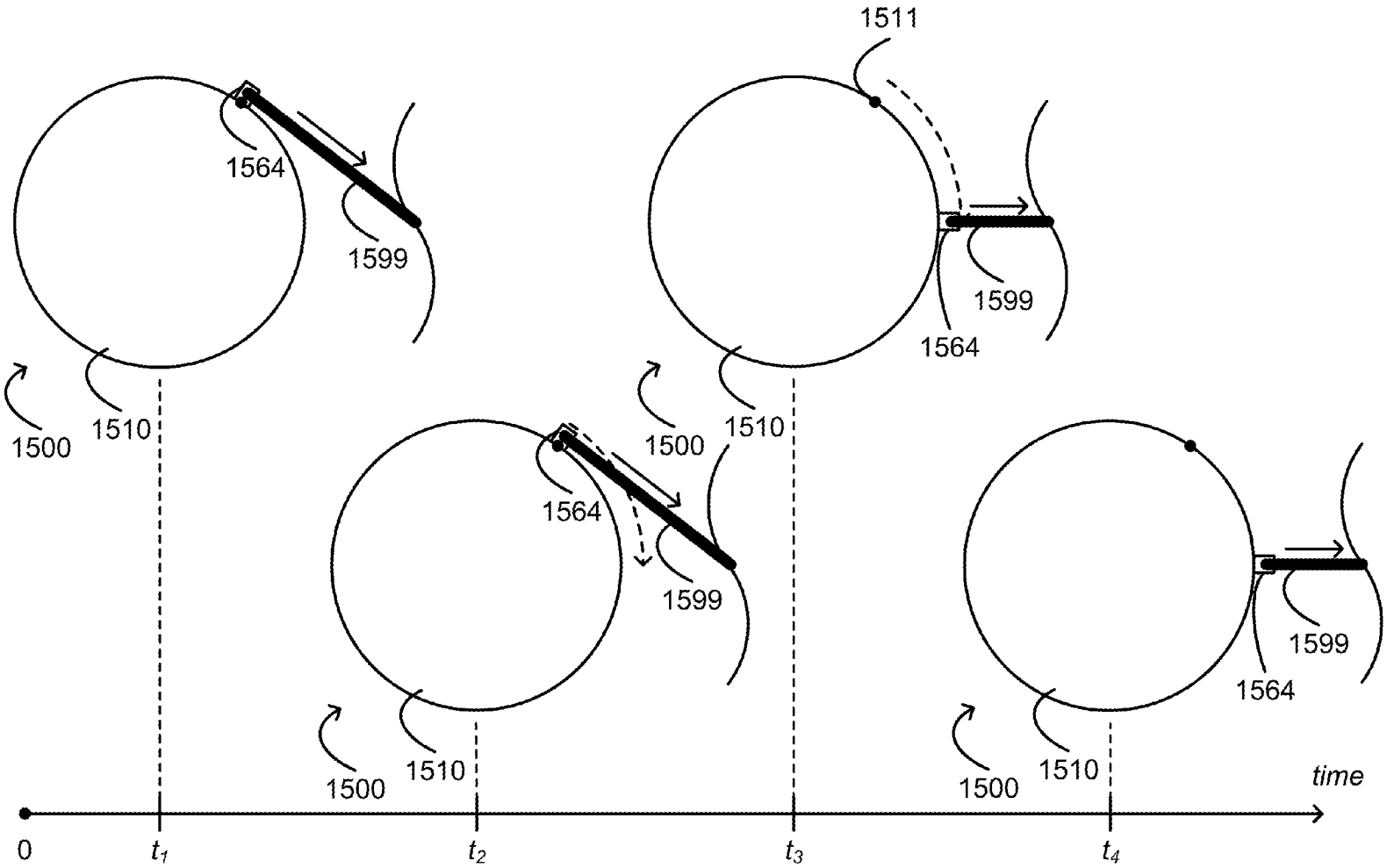

FIG. 15 provides a schematic of an apparatus adjusting to an applied resistance band-pulling force in accordance with some embodiments.

Figure 16:
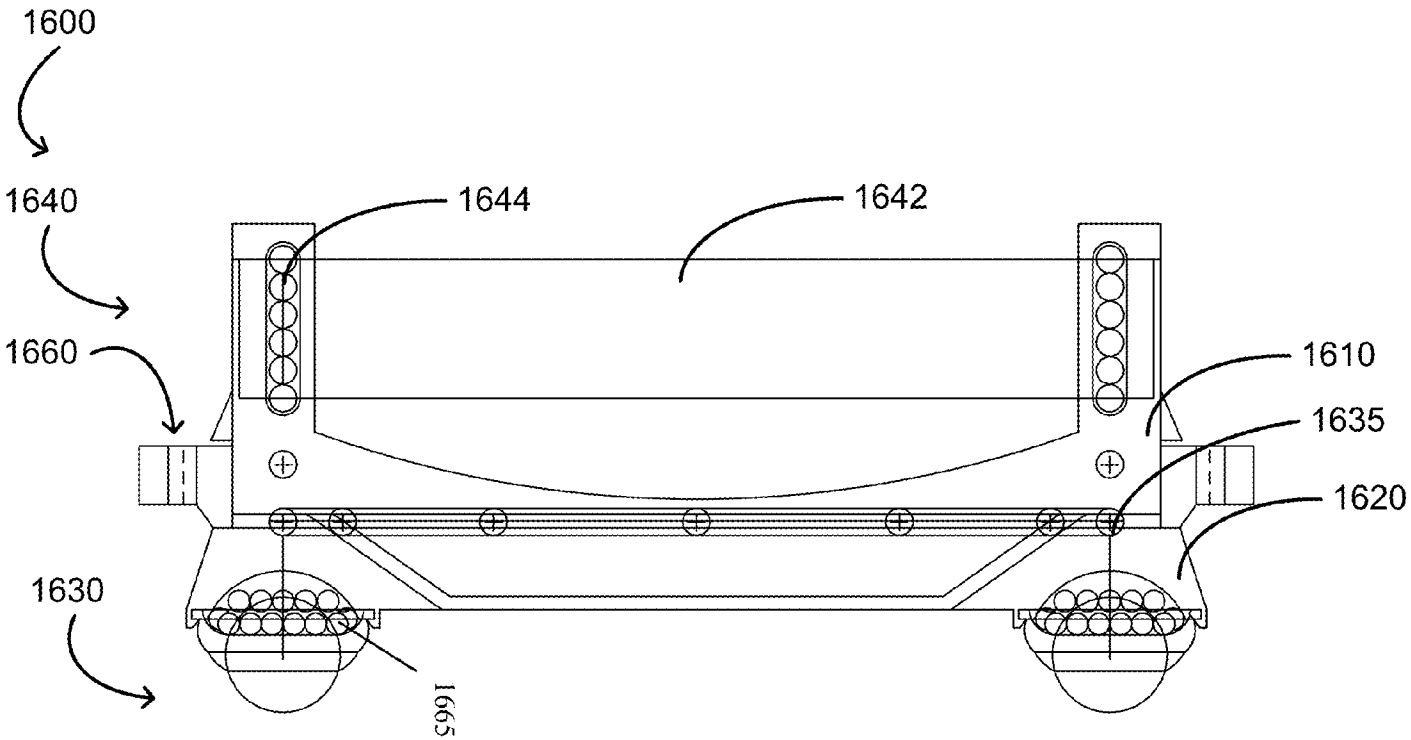

FIG. 16 provides a schematic of an apparatus configured to couple with a hand in accordance with some embodiments.

Figure 17A:
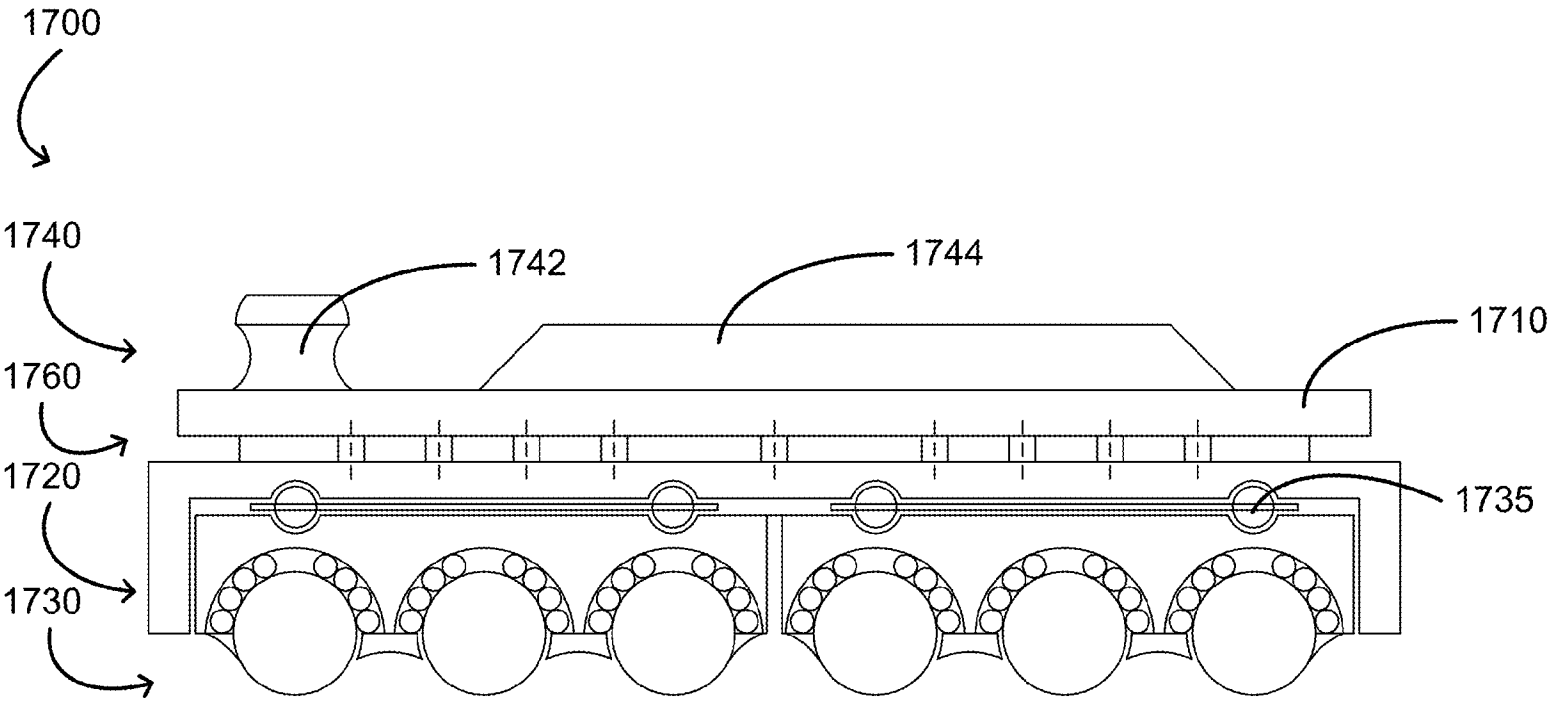

FIG. 17A provides a schematic of an apparatus configured to couple with a forearm in accordance with some embodiments.

Figure 17B:
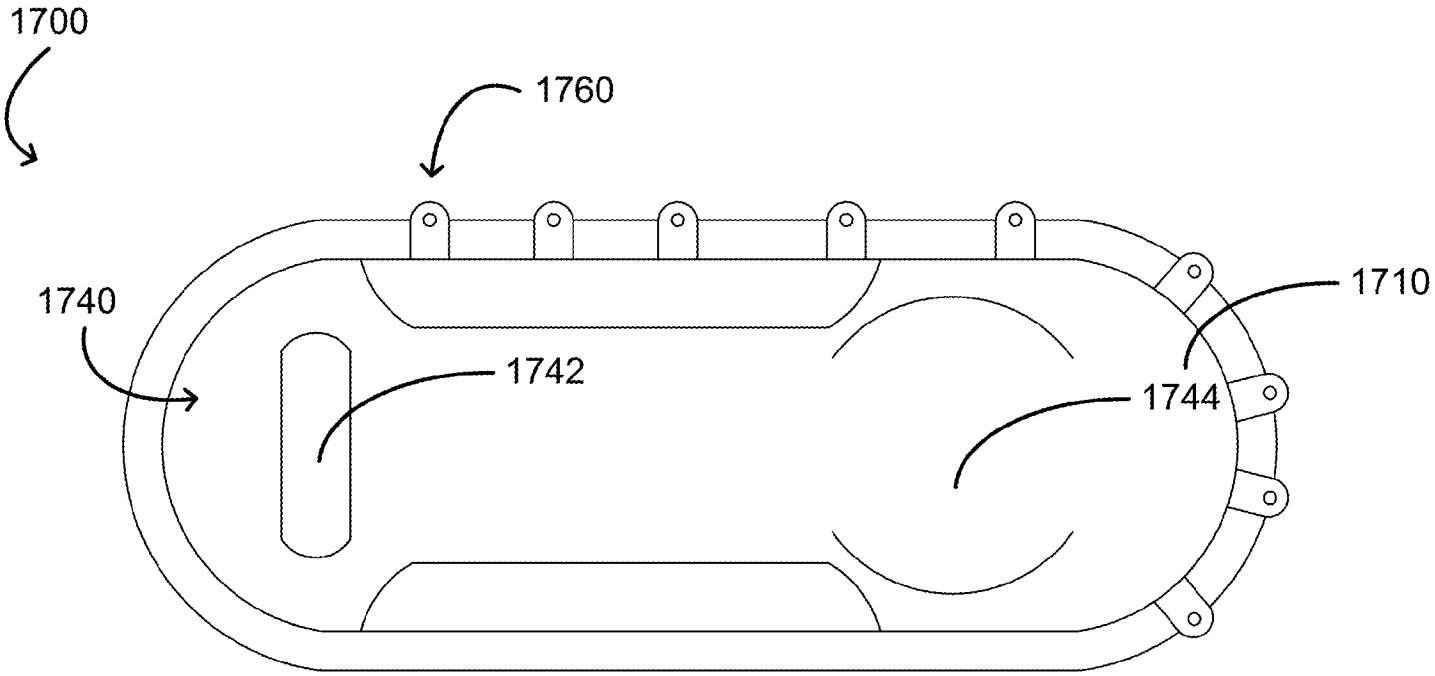

FIG. 17B provides a schematic of an apparatus configured to couple with a forearm in accordance with some embodiments.

Figure 18A:
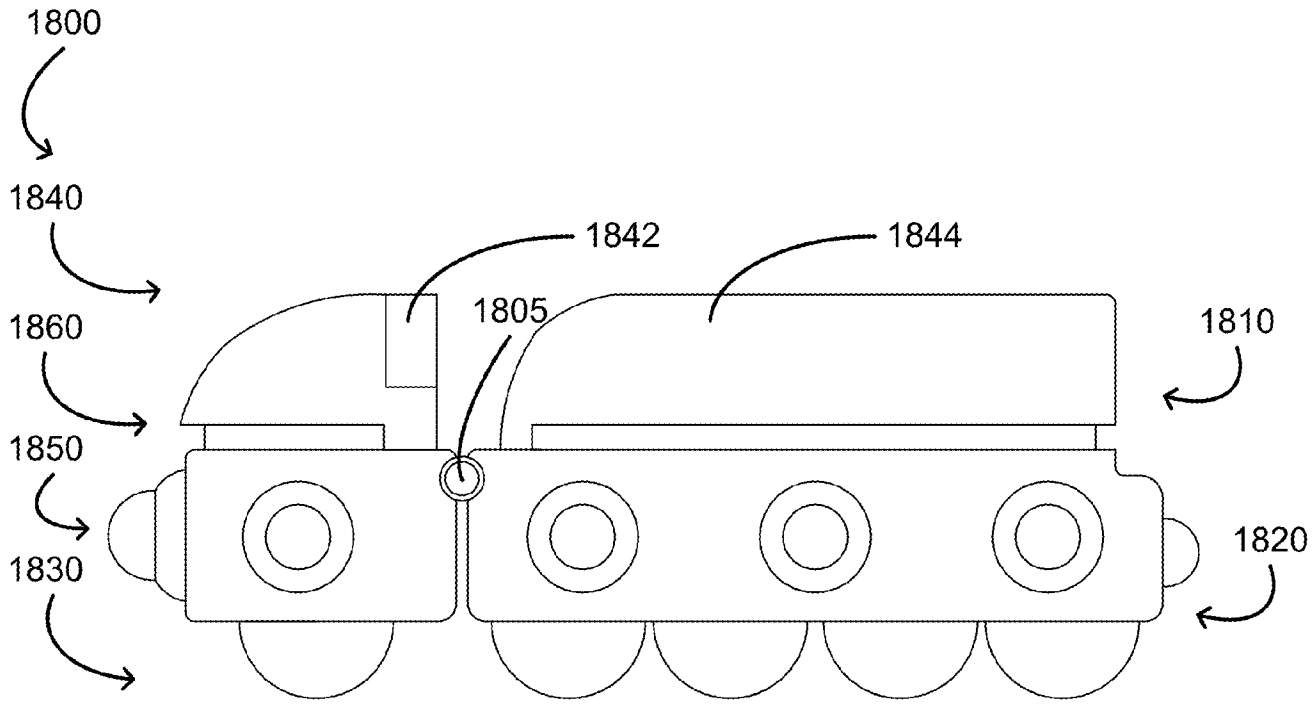

FIG. 18A provides a schematic of an apparatus configured to couple with a foot in accordance with some embodiments.

Figure 18B:
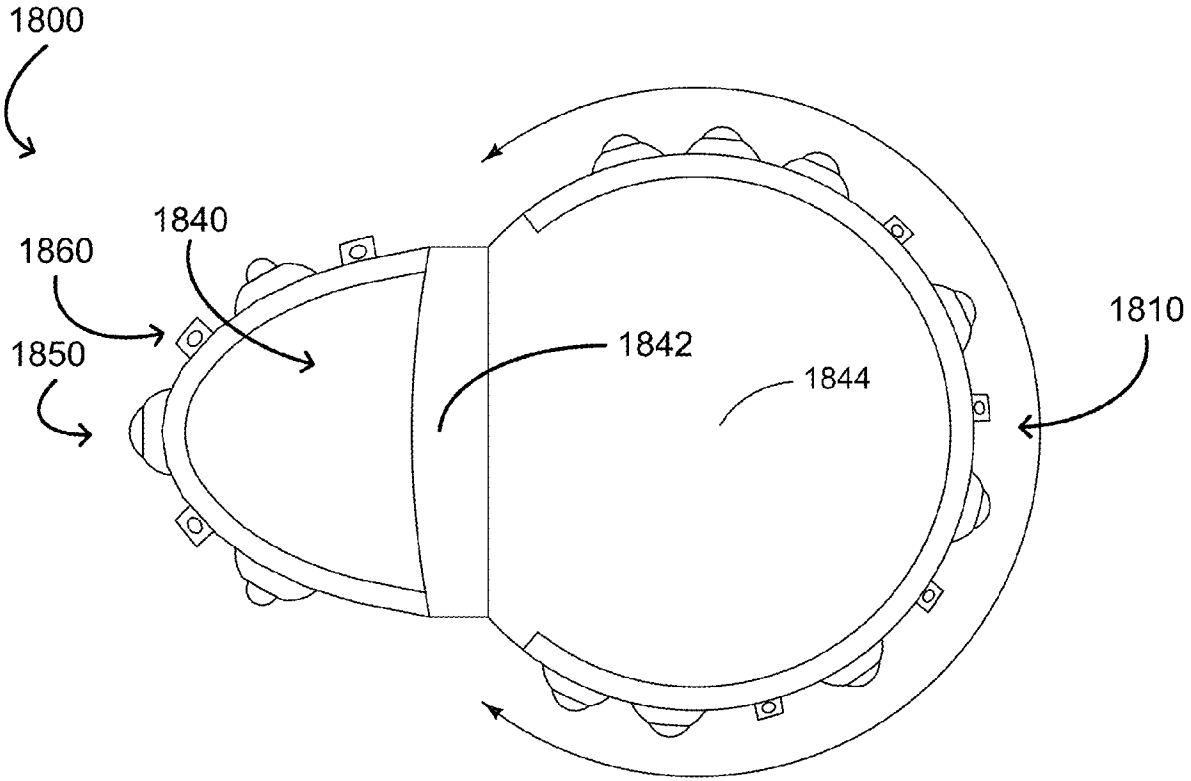

FIG. 18B provides a schematic of an apparatus configured to couple with a foot in accordance with some embodiments.

Figure 19A:
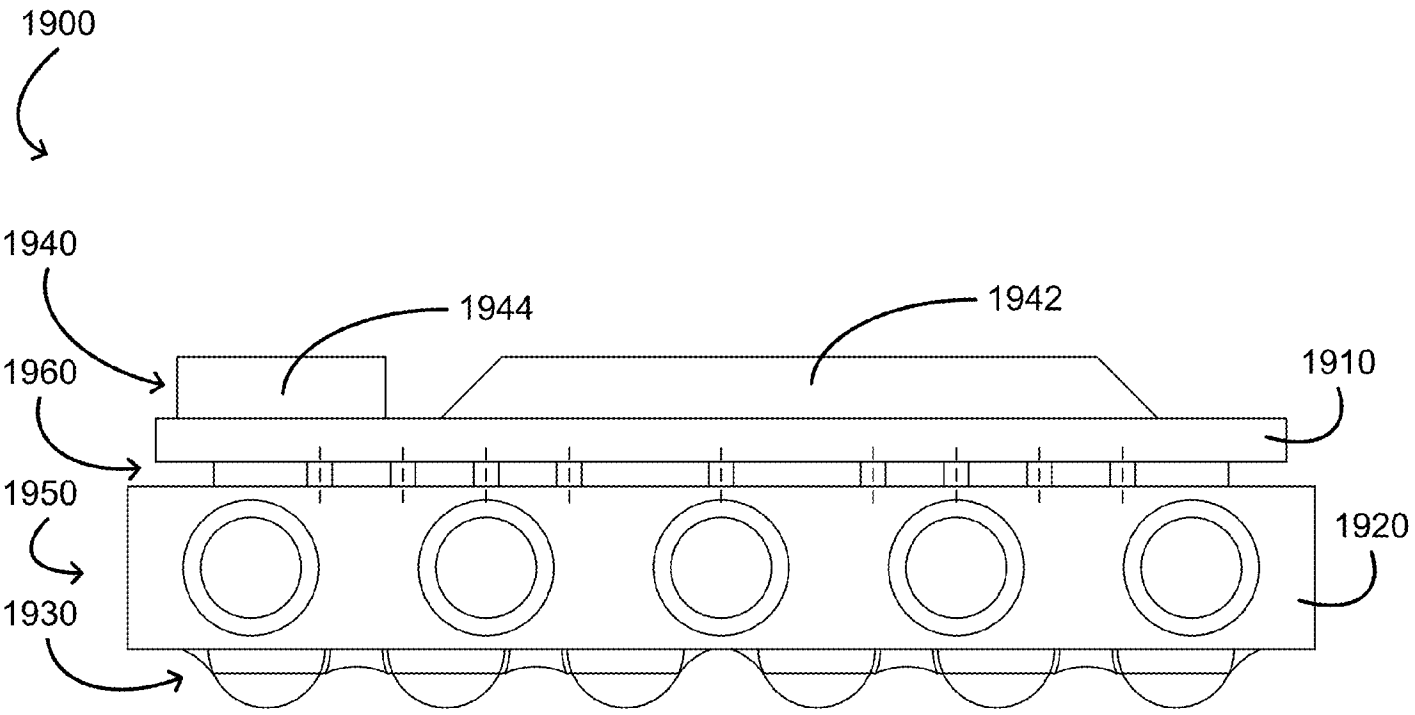

FIG. 19A provides a schematic of an apparatus configured to couple with a shin in accordance with some embodiments.

Figure 19B:
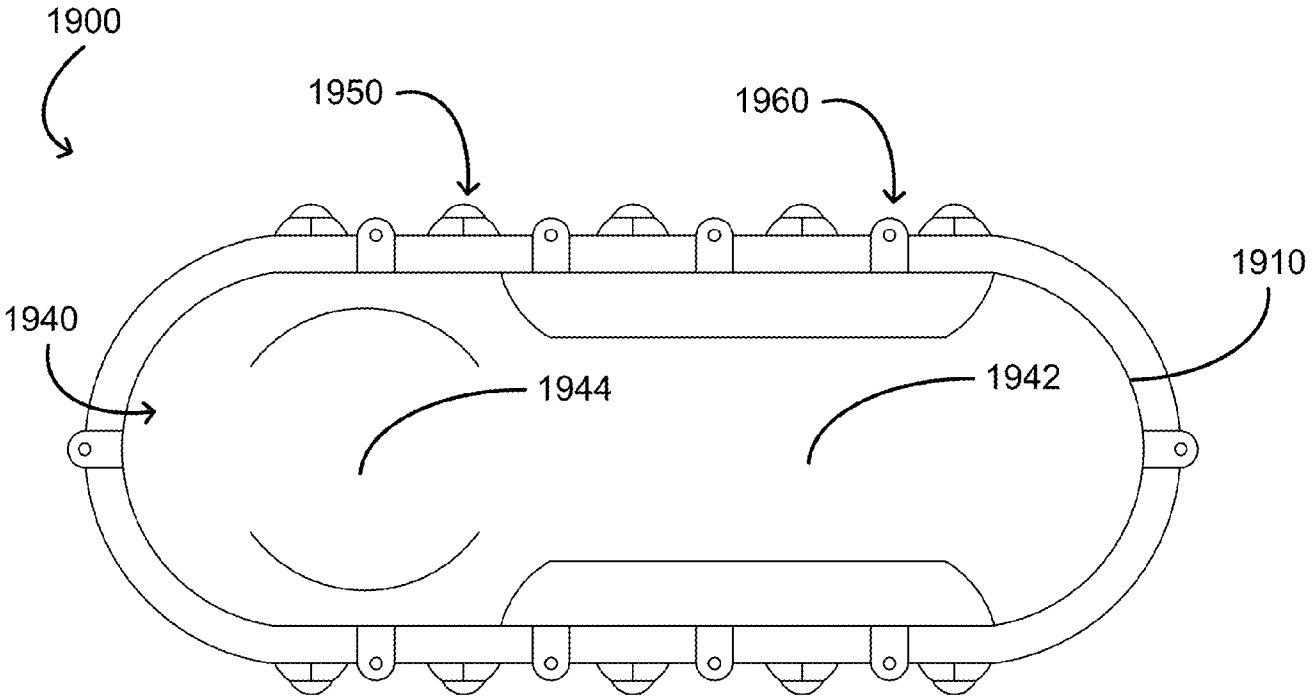

FIG. 19B provides a schematic of an apparatus configured to couple with a shin in accordance with some embodiments.

DESCRIPTION

Before some particular embodiments are provided in greater detail, persons having ordinary skill in the art should understand the following:

The particular embodiments do not limit the scope of the invention as such particular embodiments may vary.

A particular embodiment has features that may be readily separated from the particular embodiment and optionally combined with or substituted for features in any of several other embodiments.

Terminology used herein is for the purpose of describing some particular embodiments, and the terminology does not limit the scope of the invention.

Unless indicated otherwise, ordinal numbers (e.g., first, second, third, etc.) are used to distinguish or identify different elements or steps in a group of elements or steps, and do not supply a serial or numerical limitation. For example, "first," "second," and "third" elements or steps need not necessarily appear in that order, and embodiments need not necessarily be limited to the three elements or steps.

Unless indicated otherwise, any labels such as "left," "right," "front," "back," "top," "bottom," "forward," "reverse," "clockwise," "counter clockwise," "up," and "down," or other similar terms such as "upper," "lower," "aft," "fore," "vertical," "horizontal," "proximal," "distal," or the like, are used for convenience. Such labels are not intended to imply any particular fixed location, orientation, or direction. Instead, such labels are used to reflect relative location, orientation, or direction.

Unless the context clearly dictates otherwise, the singular forms of "a," "an," and "the" include plural references.

Unless defined otherwise, all technical and scientific terms used herein have the same meaning as commonly understood by persons having ordinary skill in the art.

Physical exercise reduces stress and improves overall health. Physical exercise includes a number of different training methods, including strength training, which includes creating a force resistant to contraction of one or more muscles. While strength training is generally performed to increase muscle strength and size, there are many other benefits as well. Such benefits include improved cardiac function, posture, and joint function; reduced potential for injury; and increased metabolism and bone density. As such, there is a need for systems and methods for physical exercise provided herein.

In accordance with some embodiments, one or more apparatuses (e.g., apparatuses 100A, 100B, and 100C of FIGS. 1A, 1B, and 1C, respectively) may be used in systems for physical exercise. In accordance with some embodiments, each of the one or more apparatuses of the system may be coupled with an anatomical appendage or a structure thereof of a user, and the user may subsequently move the anatomical appendage(s) or the structure(s) thereof over an extrinsic surface in methods for physical exercise. Different combinations of the one or more apparatuses provide different systems for physical exercise and, in turn, provide different methods for physical exercise.

Before apparatuses for coupling to particular anatomical appendages or structures thereof (e.g., hand, forearm, foot, shin, etc.) are described, some apparatuses including some common features to the foregoing will be described. As such, one or more apparatuses including 100A, 100B, and 100C of FIGS. 1A, 1B, and 1C, respectively, will be described before the apparatus 1600 of FIG. 16 for coupling to a hand, the apparatus 1700 of FIGS. 17A and 17B for coupling to a forearm, the apparatus 1800 of FIGS. 18A and 18B for coupling to a foot, and the apparatus 1900 of FIGS. 19A and 19B for coupling to a shin.

FIG. 1A provides a schematic of an apparatus in accordance with some embodiments. It should be understood that FIG. 1A is intended to provide a basis from which to describe certain features of apparatuses for the systems and methods for physical exercise provided herein. FIG. 1A is not intended to limit the apparatuses for the systems and methods for physical exercise provided herein.

As shown in FIG. 1A, an apparatus 100A (side view) may include a top member 110, a bottom member 120 integral with or coupled to the top member 110, and a movement-enabling mechanism 130 for moving the apparatus 100A over an extrinsic surface. The movement-enabling mechanism 130 may be integral with the bottom member 120, coupled to a bottom surface of the bottom member 120, or recessed into a bottom surface of the bottom member 120 and coupled thereto. The apparatus 100A may optionally include a component 140 configured to couple with one or more anatomical appendages or structures thereof (e.g., hand, forearm, foot, shin, etc.).

FIG. 1B provides a schematic of an apparatus in accordance with some embodiments. It should be understood that FIG. 1B is intended to provide a basis from which to describe certain features of apparatuses for the systems and methods for physical exercise provided herein. FIG. 1B is not intended to limit the apparatuses for the systems and methods for physical exercise provided herein.

As shown in FIG. 1B, an apparatus 100B (side view) may include a top member 110, a number of bottom members 120 (e.g., a bottom member 120A; a bottom member 120B; etc.) integral with or coupled to the top member 110, and a number of movement-enabling mechanisms 130 (e.g., a movement-enabling mechanism 130A; a movement-enabling mechanism 130B; etc.) for moving the apparatus 100B over an extrinsic surface. Each of the number of movement-enabling mechanisms 130 may be integral with a respective bottom member, coupled to a bottom surface of a respective bottom member, or recessed into a bottom surface of a respective bottom member and coupled thereto. For example, the movement-enabling mechanism 130A may be integral with the bottom member 130A, coupled to a bottom surface of the bottom member 130A, or recessed into the bottom surface of the bottom member 130A and coupled thereto. Likewise, the movement-enabling mechanism 130B may be integral with the bottom member 130B, coupled to a bottom surface of the bottom member 130B, or recessed into the bottom surface of the bottom member 130B and coupled thereto. The apparatus 100B may optionally include a component 140 configured to couple with one or more anatomical appendages or structures thereof (e.g., hand, forearm, foot, shin, etc.).

FIGS. 1C and 1D provide schematics of an apparatus in accordance with some embodiments. It should be understood that FIGS. 1C and 1D are intended to provide a basis from which to describe certain features of apparatuses for the systems and methods for physical exercise provided herein. FIGS. 1C and 1D are not intended to limit the apparatuses for the systems and methods for physical exercise provided herein.

As shown in FIGS. 1C and 1D, an apparatus 100C (side view) may include a number of top members 110 (e.g., a top member 110A; a top member 110B; etc.), a number of bottom members 120 (e.g., a bottom member 120A; a bottom member 120B; etc.), and a number of movement-enabling mechanisms 130 (e.g., a movement-enabling mechanism 130A; a movement-enabling mechanism 130B;

etc.) for moving the apparatus 100C over an extrinsic surface. The apparatus 100C may optionally include a number of components 140 (e.g., a component 140A; a component 140B; etc.) configured to couple with one or more anatomical appendages or structures thereof (e.g., hand, forearm, foot, shin, etc.). The top member 110A, the bottom member 120A, the movement-enabling mechanism 130A, and the component 140A may be structured in a first stack similar to that described in reference to FIG. 1A. Likewise, the top member 110B, the bottom member 120B, the movement-enabling mechanism 130B, and the component 140B may be structured in a second stack similar to that described in reference to FIG. 1A.

As shown in FIGS. 1C and 1D, the apparatus 100C (side view) may include a hinge 105 between the first stack (e.g., the top member 110A, the bottom member 120A, the movement-enabling mechanism 130A, and the component 140A) and the second stack (e.g., the top member 110B, the bottom member 120B, the movement-enabling mechanism 130B, and the component 140B). The hinge 105 may be configured to allow one of the first stack or the second stack to lift from an extrinsic surface and toward the other one of the first stack or the second stack while maintaining contact with the extrinsic surface. For example, as shown in FIG. 1C, the hinge 105 may be configured to allow the second stack to lift toward the first stack as indicated by the arrow. As shown in FIG. 1D, the hinge 105 may be configured to allow the second stack to lift from the extrinsic surface while the first stack maintains contact with the extrinsic surface. The hinge 105 allows for more natural movement when the apparatus 100C is coupled with an anatomical appendage or structure thereof having one or more joints (e.g., metatarsophalangeal articulations of foot).

The bottom member 120 of the apparatus 100A, as well as each of the number of bottom members 120 of the apparatus 100B or 100C, may be fixedly or rotatably coupled to its respective top member 110. FIG. 2A shows a non-limiting example of a bottom member of an apparatus rotatably coupled to a top member. Each of FIGS. 2B and 2C shows a non-limiting example of a number of bottom members of an apparatus rotatably coupled to a top member.

FIG. 2A expands upon at least FIG. 1A and provides a schematic of an apparatus including a lazy Susan or turntable bearing in accordance with some embodiments. It should be understood that FIG. 2A is intended to provide a basis from which to describe certain features (e.g., lazy Susans or turntable bearings) of apparatuses for the systems and methods for physical exercise provided herein. FIG. 2A is not intended to limit the apparatuses for the systems and methods for physical exercise provided herein, and the certain features (e.g., lazy Susans or turntable bearings) described in reference to FIG. 2A are not limited thereto.

As shown in FIG. 2A, an apparatus 200A (side view) may include a top member 110, a bottom member 120 rotatably coupled to the top member 110, and a movement-enabling mechanism 130 for moving the apparatus 200A over an extrinsic surface. The bottom member 120 may be rotatably coupled to the top member 110 through a lazy Susan or turntable bearing 235, which turntable bearing 235 may be configured to compensate for a point of lock up as described herein. The movement-enabling mechanism 130 may be integral with the bottom member 120, coupled to a bottom surface of the bottom member 120, or recessed into a bottom surface of the bottom member 120 and coupled thereto. The apparatus 200A may optionally include a component 140 configured to couple with one or more anatomical appendages or structures thereof (e.g., hand, forearm, foot, shin, etc.).

FIG. 2B expands upon at least FIG. 1B and provides a schematic of an apparatus including a lazy Susan or turntable bearing in accordance with some embodiments. It should be understood that FIG. 2B is intended to provide a basis from which to describe certain features (e.g., lazy Susans or turntable bearings) of apparatuses for the systems and methods for physical exercise provided herein. FIG. 2B is not intended to limit the apparatuses for the systems and methods for physical exercise provided herein, and the certain features (e.g., lazy Susans or turntable bearings) described in reference to FIG. 2B are not limited thereto.

As shown in FIG. 2B, an apparatus 200B (side view) may include a top member 110, a number of bottom members 120 (e.g., a bottom member 120A; a bottom member 120B; etc.) rotatably coupled to the top member 110, and a number of movement-enabling mechanisms 130 (e.g., a movement-enabling mechanism 130A; a movement-enabling mechanism 130B; etc.) for moving the apparatus 200B over an extrinsic surface. Each of the number of bottom members 120 may be rotatably coupled to the top member 110 through a respective lazy Susan or turntable bearing (e.g., a turntable bearing 235A; a turntable bearing 235B; etc.), which turntable bearing may be configured to compensate for a point of lock up as described herein. As described herein, each of the number of movement-enabling mechanisms 130 may be integral with a respective bottom member, coupled to a bottom surface of a respective bottom member, or recessed into a bottom surface of a respective bottom member and coupled thereto. The apparatus 200B may optionally include a component 140 configured to couple with one or more anatomical appendages or structures thereof (e.g., hand, forearm, foot, shin, etc.).

FIG. 2C expands upon at least FIGS. 1C and 1D and provides a schematic of an apparatus including a lazy Susan or turntable bearing in accordance with some embodiments. It should be understood that FIG. 2C is intended to provide a basis from which to describe certain features (e.g., lazy Susans or turntable bearings) of apparatuses for the systems and methods for physical exercise provided herein. FIG. 2C is not intended to limit the apparatuses for the systems and methods for physical exercise provided herein, and the certain features (e.g., lazy Susans or turntable bearings) described in reference to FIG. 2C are not limited thereto.

As shown in FIG. 2C, an apparatus 200C (side view) may include a number of top members 110 (e.g., a top member 110A; a top member 110B; etc.), a number of bottom members 120 (e.g., a bottom member 120A; a bottom member 120B; etc.), and a number of movement-enabling mechanisms 130 (e.g., a movement-enabling mechanism 130A; a movement-enabling mechanism 130B; etc.) for moving the apparatus 200C over an extrinsic surface. The apparatus 200C may optionally include a number of components 140 (e.g., a component 140A; a component 140B; etc.) configured to couple with one or more anatomical appendages or structures thereof (e.g., hand, forearm, foot, shin, etc.). The top member 110A, the bottom member 120A, the movement-enabling mechanism 130A, and the component 140A may be structured in a first stack with a lazy Susan or turntable bearing 235A configured to compensate for a point of lock up as described herein. Likewise, the top member 110B, the bottom member 120B, the movement-enabling mechanism 130B, and the component 140B may be structured in a second stack with a lazy Susan or turntable bearing 235B configured to compensate for a point of lock up as described herein. A hinge 105 described in reference to at least FIGS. 1C and 1D allows for more natural movement when the apparatus 200C is coupled with an anatomical appendage or structure thereof having one or more joints (e.g., metatarsophalangeal articulations of foot).

FIG. 3 provides a schematic of an apparatus compensating for a point of lock up in accordance with some embodiments of the systems and methods for physical exercise provided herein.

As shown in FIG. 3, an apparatus 300 (top view) may include a top member 310 and a bottom member 320 rotatably coupled to the top member 310. While the bottom member 320 is shown as having a greater diameter than the top member 310, it should be understood that the greater diameter is for an illustrative purpose. The bottom member 320 need not have a greater diameter than the top member 310. For example, the bottom member 320 may have a smaller diameter or equal diameter to top member 310. As described herein, the bottom member 320 may be rotatably coupled to the top member 310 through a turntable bearing (e.g., turntable bearing 235 of FIG. 2A). Also as described herein, a movement-enabling mechanism (e.g., movement-enabling mechanism 130 of FIG. 2A) may be integral with or coupled to the bottom member 320.

As shown in FIG. 3, at a time $t_1$ and a position $x_1$, the apparatus 300 may have a velocity 302 (e.g., linear velocity, angular velocity, etc.) over an extrinsic surface in a direction toward a surface irregularity 399 (e.g., surface bump, surface hole, surface scratch, debris, etc.). At a time $t_2$ and a position $x_2$, the apparatus 300 may maintain the velocity 302 or minimize any loss in the velocity 302 while engaging the surface irregularity 399. On account of the turntable bearing (e.g., turntable bearing 235 of FIG. 2A) positioned between the top member 310 and the bottom member 320, the bottom member 320 is configured to rotate in response to the movement-enabling mechanism (e.g., movement-enabling mechanism 130 of FIG. 2A) engaging the surface irregularity 399, thereby maintaining the velocity 302 or minimizing any loss in the velocity 302. The counterclockwise-oriented arrows leading from a visual indicator 321 (not necessarily part of the apparatus) on the bottom member 320 and the surface irregularity 399 illustrate how the bottom member 320 rotates in response to the movement-enabling mechanism engaging the surface irregularity 399. At a time $t_3$ and a position $x_3$, the apparatus 300 may maintain the velocity 302 or minimize any loss in the velocity 302 while disengaging the surface irregularity 399. The counterclockwise-oriented arrows leading to the visual indicator 321 and the surface irregularity 399 illustrate how the bottom member 320 rotated in response to the movement-enabling mechanism engaging the surface irregularity 399. The visual indicator 321 in relation to a visual indicator 311 on the top member 310 illustrates an angle through which the bottom member 320 rotated in response to the movement-enabling mechanism engaging the surface irregularity 399. At a time $t_4$ and a position $x_4$, the apparatus 300 may have the velocity 302 over the extrinsic surface in a direction away from the surface irregularity 399. In view of the foregoing, the turntable bearing may also be considered part of the movement-enabling mechanism because the turntable bearing and the movement-enabling mechanism may operate in concert to maintain the velocity or minimize any loss in the velocity in the event of a lock up.

It should be understood that the bottom member is free to rotate in a clockwise or counterclockwise direction, depending on the location of the surface irregularity. In addition, it should be understood that a surface irregularity (e.g., surface bump, surface hole, surface scratch, debris, etc.) in an extrinsic surface need not be present for a lock up in a movement-enabling mechanism. A lock up may also result from a manufacturing imperfection in the movement-enabling mechanism or an element thereof. However, it has been discovered that an imperfectly manufactured movement-enabling mechanism is sufficient for systems and methods for exercise provided herein due, in part, to the turntable bearing action described herein.

The movement-enabling mechanism, alone or in part, enables omni-directional movement of an apparatus over an extrinsic surface, which may be without substantial interruption as described in reference to FIG. 3. The movement-enabling mechanism may include, but is not limited to, a gliding mechanism, a rolling mechanism, or a combination of the foregoing. The apparatus including the movement-enabling mechanism may enable omni-directional movement under a weight ranging from that of the apparatus alone to that of the apparatus in combination with at least a 100 kg user of the apparatus, wherein at least 100 kg includes 100 kg or more, such as 125 kg or more, and, for example, 150 kg or more.

A gliding mechanism may include a glide plate coupled to a bottom member of the apparatus, such as a glide plate formed apart from a bottom member and subsequently affixed thereto. While each of the movement-enabling mechanisms 130 of FIGS. 1A, 1B, 1C, 1D, 2A, 2B, and 2C is intended to be generic, each of the foregoing movement-enabling mechanisms may be considered a glide plate coupled to a bottom member.

A gliding mechanism may include a glide plate integral with a bottom member of the apparatus, such as a glide plate formed with or on a bottom member.

The glide plate may include a composition for facilitating gliding across a desired extrinsic surface. The composition may include, but is not limited to, a composition having a low coefficient of friction against the desired extrinsic surface. Such a composition may include a polymer, a glass, a ceramic, a composite, a metal, a metalloid, a non-metal, or a combination of one or more of the foregoing. For example, the composition may include a polymer including a low coefficient of friction (e.g., polytetrafluoroethylene or Teflon®). Such a polymer may further include a moldable polymer such as an injection-moldable polymer (e.g., polytetrafluoroethylene or Teflon®). Such a polymer may even further include a printable polymer such as a 3-D-printable polymer.

A rolling mechanism may be coupled to a bottom surface of a bottom member of the apparatus, such as a rolling mechanism including a number of rolling elements individually coupled to a bottom surface of a bottom member. While each of the movement-enabling mechanisms 130 of FIGS. 1A, 1B, 1C, 1D, 2A, 2B, and 2C is intended to be generic, each of the foregoing movement-enabling mechanisms may be considered a rolling mechanism coupled to a bottom surface of a bottom member.

A rolling mechanism may be recessed into a bottom surface of a bottom member of the apparatus and coupled thereto, such as a rolling mechanism including a number of rolling elements individually recessed into a bottom surface of a bottom member and coupled thereto. Each rolling mechanism of FIGS. 4A, 4B, and 4C may be considered a number of rolling elements recessed into a bottom surface of a bottom member and coupled thereto.

A rolling mechanism may be integral with a bottom member of the apparatus, such as a rolling mechanism including a number of rolling elements (or portions thereof)

individually integral with a bottom member. Each rolling mechanism of FIGS. 4A, 4B, and 4C may be considered a number of rolling elements (or portions thereof) integral with a bottom member.

FIG. 4A expands upon at least FIG. 1A or 2A and provides a schematic of an apparatus including a rolling mechanism in accordance with some embodiments. It should be understood that FIG. 4A is intended to provide a basis from which to describe certain features (e.g., rolling mechanisms) of apparatuses for the systems and methods for physical exercise provided herein. FIG. 4A is not intended to limit the apparatuses for the systems and methods for physical exercise provided herein, and the certain features (e.g., rolling mechanisms) described in reference to FIG. 4A are not limited thereto.

As shown in FIG. 4A, an apparatus 400A (side view) may include a top member 110, a bottom member 120 rotatably coupled to the top member 110 through a turntable bearing 235 configured to compensate for a point of lock up as described herein, and a rolling mechanism 430 for rolling the apparatus 400A over an extrinsic surface. The rolling mechanism 430 may be integral with the bottom member 120, coupled to a bottom surface of the bottom member 120, or recessed into a bottom surface of the bottom member 120 and coupled thereto. The rolling mechanism 430 may include a number of rolling elements, and the rolling elements or portions thereof may be integral with the bottom member 120, coupled to a bottom surface of the bottom member 120, or recessed into a bottom surface of the bottom member 120 and coupled thereto. The apparatus 400A may optionally include a component 140 configured to couple with one or more anatomical appendages or structures thereof (e.g., hand, forearm, foot, shin, etc.).

FIG. 4B expands upon at least FIG. 1B or 2B and provides a schematic of an apparatus including a rolling mechanism in accordance with some embodiments. It should be understood that FIG. 4B is intended to provide a basis from which to describe certain features (e.g., rolling mechanisms) of apparatuses for the systems and methods for physical exercise provided herein. FIG. 4B is not intended to limit the apparatuses for the systems and methods for physical exercise provided herein, and the certain features (e.g., rolling mechanisms) described in reference to FIG. 4B are not limited thereto.

As shown in FIG. 4B, an apparatus 400B (side view) may include a top member 110, a number of bottom members 120 (e.g., a bottom member 120A; a bottom member 120B; etc.) rotatably coupled to the top member 110 through a respective turntable bearing (e.g., a turntable bearing 235A; a turntable bearing 235B; etc.) configured to compensate for a point of lock up as described herein, and a number of rolling mechanisms 430 (e.g., a rolling mechanism 430A; a rolling mechanism 430B; etc.) for rolling the apparatus 400B over an extrinsic surface. As described herein, each of the number of rolling mechanisms 430 may be integral with a respective bottom member, coupled to a bottom surface of a respective bottom member, or recessed into a bottom surface of a respective bottom member and coupled thereto. The rolling mechanism 430 may include a number of rolling elements, and the rolling elements or portions thereof may be integral with a respective bottom member, coupled to a bottom surface of a respective bottom member, or recessed into a bottom surface of a respective bottom member and coupled thereto. The apparatus 400B may optionally include a component 140 configured to couple with one or more anatomical appendages or structures thereof (e.g., hand, forearm, foot, shin, etc.).

FIG. 4C expands upon at least FIGS. 1C and 1D or FIG. 2C and provides a schematic of an apparatus including a rolling mechanism in accordance with some embodiments. It should be understood that FIG. 4C is intended to provide a basis from which to describe certain features (e.g., rolling mechanisms) of apparatuses for the systems and methods for physical exercise provided herein. FIG. 4C is not intended to limit the apparatuses for the systems and methods for physical exercise provided herein, and the certain features (e.g., rolling mechanisms) described in reference to FIG. 4C are not limited thereto.

As shown in FIG. 4C, an apparatus 400C (side view) may include a number of top members 110 (e.g., a top member 110A; a top member 110B; etc.), a number of bottom members 120 (e.g., a bottom member 120A; a bottom member 120B; etc.), and a number of rolling mechanisms 430 (e.g., a rolling mechanism 430A; a rolling mechanism 430B; etc.) for moving the apparatus 400C over an extrinsic surface. The apparatus 400C may optionally include a number of components 140 (e.g., a component 140A; a component 140B; etc.) configured to couple with one or more anatomical appendages or structures thereof (e.g., hand, forearm, foot, shin, etc.). As described herein, the top member 110A, the bottom member 120A, the rolling mechanism 430A, and the component 140A may be structured in a first stack with a turntable bearing 235A; the top member 110B, the bottom member 120B, the rolling mechanism 430B, and the component 140B may be structured in a second stack with a turntable bearing 235B; and a hinge 105 between the first stack and the second stack allows for more natural movement when the apparatus 400C is coupled with an anatomical appendage or structure thereof having one or more joints (e.g., metatarsophalangeal articulations of foot). As described herein, each of the number of rolling mechanisms 430 may be integral with a respective bottom member, coupled to a bottom surface of a respective bottom member, or recessed into a bottom surface of a respective bottom member and coupled thereto. The rolling mechanism 430 may include a number of rolling elements, and the rolling elements or portions thereof may be integral with a respective bottom member, coupled to a bottom surface of a respective bottom member, or recessed into a bottom surface of a respective bottom member and coupled thereto.

A rolling mechanism may include, but is not limited to, one or more rolling elements arranged about a bottom member of the apparatus.

FIG. 5 provides a schematic of a rolling mechanism with a number of rolling elements in accordance with some embodiments of the systems and methods for physical exercise provided herein.

As shown in FIG. 5, an apparatus may include a bottom member 120 (top view) and a rolling mechanism 430 including a number of rolling elements (e.g. a rolling element 430*a*, a rolling element 430*b*, . . . , 430*f*), wherein the number of rolling elements or portions thereof may be integral with the bottom member 120, coupled to a bottom surface of the bottom member 120, or recessed into a bottom surface of the bottom member 120 and coupled thereto for moving the apparatus over an extrinsic surface. The number of rolling elements may include any number of rolling elements in any desired arrangement. As shown in FIG. 5, for example, at least six rolling elements are arranged in an annulus about the bottom member 120 of the apparatus.

A rolling mechanism may include, but is not limited to, one or more rolling elements selected from ball transfer units or ball transfer bearings, castors, rollers, and wheels. In some embodiments, for example, the rolling mechanism includes a number of ball transfer bearings. FIGS. 6A and 6B show a non-limiting example of a ball transfer bearing.

FIGS. 6A and 6B provide schematics of a ball transfer bearing in accordance with some embodiments of the systems and methods for physical exercise provided herein.

As shown in FIG. 6A, a ball transfer bearing 430*a* (side view) may include a primary or main ball 610 for contacting and omni-directionally rolling over an extrinsic surface while the ball transfer bearing 430*a* is in an inverted or "ball down" orientation.

Ball transfer bearings are generally designed to bear loads in a "ball up" orientation. When used in the "ball down" orientation as shown in FIG. 6A, ball transfer bearings may have load-bearing limitations, which may lead to lock ups. Despite load-bearing limitations in the "ball down" orientation, it has been discovered that ball transfer bearings in the "ball down" orientation are sufficient for the loads of systems and methods for exercise provided herein.

As shown in FIG. 6B, the ball transfer bearing 430*a* (cross-sectional view) may include secondary or load-transmitting balls 612, which work in concert with the main ball 610 for load supporting and omni-directionally rolling over an extrinsic surface.

Ball transfer bearings are often designed to bear loads with recirculating, load-transmitting balls. When used with non-recirculating, load-transmitting balls as shown in FIG. 6A, ball transfer bearings may have load-bearing limitations, which may lead to lock ups. Despite load-bearing limitations with non-recirculating, load-transmitting balls, it has been discovered that ball transfer bearings with non-recirculating, load-transmitting balls are sufficient for the loads of systems and methods for exercise provided herein. However, to accommodate heavier loads, fewer lock ups, etc., ball transfer bearings with recirculating, load-transmitting balls may also be used in systems and methods for exercise provided herein.

As shown in FIGS. 6A and 6B, the ball transfer bearing 430*a* may include a housing 620 including a top housing 622 and a bottom housing 624, within which housing 620 the main ball 610 may freely and omni-directionally roll while being held captive.

The ball transfer bearing 430*a* of FIGS. 6A and 6B may be separately formed, recessed into a bottom member of an apparatus, and affixed to the bottom member by the top housing 622. Alternatively, the top housing 622 may be integrally formed within a bottom member of an apparatus, and the ball transfer bearing 430*a* may be assembled in the bottom member.

Whether a ball transfer bearing 430*a* is separately formed or integrally formed within a bottom member, the ball transfer bearing 430*a* may be assembled by adding the load-transmitting balls 612 to the top housing 622 while the top housing 622 is in an orientation opposite that shown in FIGS. 6A and 6B. The main ball 610 may be subsequently placed on top of the load-transmitting balls 612. The bottom housing 624 may then be placed on top of the top housing 622 and snapped into place to form the ball transfer bearing 430*a*.

One or more rolling elements or portions thereof (e.g., main ball 610, load-transmitting balls 612, or housing 620 of ball transfer bearing 430*a*), may include a composition for facilitating rolling across a desired extrinsic surface. The composition may include, but is not limited to, a composition having one or more properties selected from high strength, high density, high strength-to-density ratio, high hardness, and high rigidity. Such a composition may include a polymer, a glass, a ceramic, a composite, a metal, a metalloid, a non-metal, or a combination of one or more of the foregoing. For example, the composition may include a metal such as stainless steel. For example, the composition may include a polymer such as an injection-moldable polymer or a 3-D-printable polymer. Such a polymer includes, but is not limited to, one or more polymers selected from high-density polyethylene, nylon (or aliphatic polyamides), polyoxymethylene (or acetal).

FIG. 7 provides a schematic of an apparatus compensating for a point of lock up in accordance with some embodiments of the systems and methods for physical exercise provided herein.

As shown in FIG. 7, an apparatus 700 (top view) may include a top member 710 and a bottom member 720 rotatably coupled to the top member 710. While the bottom member 720 is shown as having a greater diameter than the top member 710, it should be understood that the greater diameter is for an illustrative purpose. The bottom member 720 may have a greater diameter than the top member 710, but the bottom member 720 need not have a greater diameter than the top member 710. As described herein, the bottom member 720 may be rotatably coupled to the top member 710 through a turntable bearing (e.g., turntable bearing 235 of FIG. 4A). Also as described herein, a rolling mechanism (e.g., rolling mechanism 430 of FIG. 4A) may be integral with or coupled to the bottom member 720.

As shown in FIG. 7, at a time $t_1$ and a position $x_1$, the apparatus 700 may have a velocity 702 (e.g., linear velocity, angular velocity, etc.) over an extrinsic surface in a direction toward a surface irregularity 799 (e.g., surface bump, surface hole, surface scratch, debris, etc.). At a time $t_2$ and a position $x_2$, the apparatus 700 may maintain the velocity 702 or minimize any loss in the velocity 702 while engaging the surface irregularity 799. On account of the turntable bearing (e.g., turntable bearing 235 of FIG. 4A) positioned between the top member 710 and the bottom member 720, the bottom member 720 is configured to rotate in response to the rolling mechanism (e.g., rolling mechanism 430 of FIG. 4A) or a rolling element thereof (e.g., ball transfer bearing) engaging the surface irregularity 799, thereby maintaining the velocity 702 or minimizing any loss in the velocity 702. The counterclockwise-oriented arrows leading from a visual indicator 721 (not necessarily part of the apparatus) on the bottom member 720 and the surface irregularity 799 illustrate how the bottom member 720 rotates in response to the rolling mechanism or a rolling element thereof (e.g., ball transfer bearing) engaging the surface irregularity 799. At a time $t_3$ and a position $x_3$, the apparatus 700 may maintain the velocity 702 or minimize any loss in the velocity 702 while disengaging the surface irregularity 799. The counterclockwise-oriented arrows leading to the visual indicator 721 and the surface irregularity 799 illustrate how the bottom member 720 rotated in response to the rolling mechanism or a rolling element thereof (e.g., ball transfer bearing) engaging the surface irregularity 799. The visual indicator 721 in relation to a visual indicator 711 on the top member 710 illustrates an angle through which the bottom member 720 rotated in response to the rolling mechanism or a rolling element thereof (e.g., ball transfer bearing) engaging the surface irregularity 799. At a time $t_4$ and a position $x_4$, the apparatus 700 may have the velocity 702 over the extrinsic surface in a direction away from the surface irregularity 799. In view of the foregoing, the turntable bearing may also be considered part of the rolling mechanism because the turntable bearing and the rolling mechanism may operate in concert to maintain the velocity or minimize any loss in the velocity in the event of a lock up.

It should be understood that the bottom member is free to rotate in a clockwise or counterclockwise direction, depending on the location of the surface irregularity. In addition, it should be understood that a surface irregularity (e.g., surface bump, surface hole, surface scratch, debris, etc.) in an extrinsic surface need not be present for a lock up in a rolling mechanism or a rolling element thereof. A lock up may also result from a manufacturing imperfection in the rolling mechanism or the rolling element thereof. A lock up may also result from using one or more ball transfer bearings in the "ball down" orientation and/or with non-recirculating, load-transmitting balls. However, it has been discovered that one or more ball transfer bearings in the "ball down" orientation and/or with non-recirculating, load-transmitting balls is sufficient for systems and methods for exercise provided herein due, in part, to the turntable bearing action provided herein.

An apparatus may include a side-mounted rolling mechanism for rolling the apparatus over an extrinsic surface, which side-mounted rolling mechanism may extend a range of motion for one or more anatomical appendages or structures thereof (e.g., hand, forearm, foot, shin, etc.) over the extrinsic surface. In combination with a movement-enabling mechanism (e.g., a gliding mechanism; a rolling mechanism; etc.) described herein, a side-mounted rolling mechanism may accommodate a greater range of motion for one or more anatomical appendages or structures thereof (e.g., hand, forearm, foot, shin, etc.) coupled to the apparatus than the movement-enabling mechanism alone.

A side-mounted rolling mechanism may be coupled to a side surface of a bottom member of the apparatus, such as a side-mounted rolling mechanism including a number of side-mounted rolling elements individually coupled to a side surface of a bottom member. Each side-mounted rolling mechanism of FIGS. 8A, 8B, and 8C may be considered a number of side-mounted rolling elements coupled to a side surface of a bottom member.

A side-mounted rolling mechanism may be recessed into a side surface of a bottom member of the apparatus and coupled thereto, such as a side-mounted rolling mechanism including a number of side-mounted rolling elements individually recessed into a side surface of a bottom member and coupled thereto. Each side-mounted rolling mechanism of FIGS. 8A, 8B, and 8C may be considered a number of side-mounted rolling elements recessed into a side surface of a bottom member and coupled thereto.

A side-mounted rolling mechanism may be integral with a side member of the apparatus, such as a side-mounted rolling mechanism including a number of side-mounted rolling elements (or portions thereof) individually integral with a side member. Each side-mounted rolling mechanism of FIGS. 8A, 8B, and 8C may be considered a number of side-mounted rolling elements (or portions thereof) integral with a bottom member.

FIG. 8A expands upon at least FIG. 1A and provides a schematic of an apparatus including a side-mounted rolling mechanism in accordance with some embodiments. It should be understood that FIG. 8A is intended to provide a basis from which to describe certain features (e.g., side-mounted rolling mechanisms) of apparatuses for the systems and methods for physical exercise provided herein. FIG. 8A is not intended to limit the apparatuses for the systems and methods for physical exercise provided herein, and the certain features (e.g., side-mounted rolling mechanisms) described in reference to FIG. 8A are not limited thereto.

As shown in FIG. 8A, an apparatus 800A (side view) may include a top member 110, a bottom member 120, a movement-enabling mechanism 130, and an optional component 140 configured to couple with one or more anatomical appendages or structures thereof (e.g., hand, forearm, foot, shin, etc.). The top member 110, the bottom member 120, the movement-enabling mechanism 130 (e.g., gliding mechanism, rolling mechanism, etc.), and the component 140 may be configured as described herein. As shown in FIG. 8A, the apparatus 800A may include side-mounted rolling mechanism 850 including a number of side-mounted rolling elements. The side-mounted rolling mechanism 850 or the number of side-mounted rolling elements thereof may be coupled to a side surface of the bottom member 120, recessed into a side surface of the bottom member 120 and coupled thereto, or integral with a side surface of the bottom member 120.

FIG. 8B expands upon at least FIG. 1B and provides a schematic of an apparatus including a side-mounted rolling mechanism in accordance with some embodiments. It should be understood that FIG. 8B is intended to provide a basis from which to describe certain features (e.g., side-mounted rolling mechanisms) of apparatuses for the systems and methods for physical exercise provided herein. FIG. 8B is not intended to limit the apparatuses for the systems and methods for physical exercise provided herein, and the certain features (e.g., side-mounted rolling mechanisms) described in reference to FIG. 8B are not limited thereto.

As shown in FIG. 8B, an apparatus 800B (side view) may include a top member 110, a number of bottom members 120 (e.g., a bottom member 120A; a bottom member 120B; etc.), a number of movement-enabling mechanisms 130 (e.g., a movement-enabling mechanism 130A; a movement-enabling mechanism 130B; etc.), and an optional component 140 configured to couple with one or more anatomical appendages or structures thereof (e.g., hand, forearm, foot, shin, etc.). The top member 110, the number of bottom members 120, the movement-enabling mechanisms 130 (e.g., gliding mechanisms, rolling mechanisms, etc.), and the component 140 may be configured as described herein. As shown in FIG. 8B, the apparatus 800B may include side-mounted rolling mechanisms 850 (e.g., a side-mounted rolling mechanism 850A; a side-mounted rolling mechanism 850B; etc.) including a number of side-mounted rolling elements. Each of the side-mounted rolling mechanisms 850 or the number of side-mounted rolling elements thereof may be coupled to a side surface of a respective bottom member, recessed into a side surface of a respective bottom member and coupled thereto, or integral with a side surface of a respective bottom member.

FIG. 8C expands upon at least FIGS. 1C and 1D and provides a schematic of an apparatus including a side-mounted rolling mechanism in accordance with some embodiments. It should be understood that FIG. 8C is intended to provide a basis from which to describe certain features (e.g., side-mounted rolling mechanisms) of apparatuses for the systems and methods for physical exercise provided herein. FIG. 8C is not intended to limit the apparatuses for the systems and methods for physical exercise provided herein, and the certain features (e.g., side-mounted rolling mechanisms) described in reference to FIG. 8C are not limited thereto.

As shown in FIG. 8C, an apparatus 800C (side view) may include a number of top members 110 (e.g., a top member 110A; a top member 110B; etc.), a number of bottom members 120 (e.g., a bottom member 120A; a bottom member 120B; etc.), a number of movement-enabling mechanisms 130 (e.g., a movement-enabling mechanism 130A; a movement-enabling mechanism 130B; etc.), and a number of optional components 140 (e.g., a component 140A; a component 140B; etc.) configured to couple with one or more anatomical appendages or structures thereof (e.g., hand, forearm, foot, shin, etc.). The number of top members 110, the number of bottom members 120, the number of movement-enabling mechanisms 130 (e.g., gliding mechanisms, rolling mechanisms, etc.), and the number of components 140 may be configured in stacks with a hinge 105 as described herein. As shown in FIG. 8C, the apparatus 800C may include side-mounted rolling mechanisms 850 (e.g., a side-mounted rolling mechanism 850A; a side-mounted rolling mechanism 850B; etc.) including a number of side-mounted rolling elements. Each of the side-mounted rolling mechanisms 850 or the number of side-mounted rolling elements thereof may be coupled to a side surface of a respective bottom member, recessed into a side surface of a respective bottom member and coupled thereto, or integral with a side surface of a respective bottom member.

A side-mounted rolling mechanism may include a number of rolling elements as described in reference to the rolling mechanism (e.g., rolling mechanism 430 of FIG. 4A). For example, a side-mounted rolling mechanism may include, but is not limited to, one or more rolling elements selected from ball transfer units or ball transfer bearings, castors, rollers, and wheels. In some embodiments, for example, the side-mounted rolling mechanism includes a number of ball transfer bearings. The number of rolling elements (e.g., ball transfer bearings) may be mounted in any desired arrangement (e.g., linear, staggered, etc.) about a side of a bottom member.

An apparatus may include a resistance band-attaching means for attaching one or more resistance bands between the apparatus and an anchor, the apparatus and one or more other apparatuses of the systems for physical exercise, or a combination of the foregoing. Resistance bands in combination with one or more apparatuses described herein provide additional systems for physical exercise and, in turn, provide additional methods for physical exercise.

FIG. 9 expands upon at least FIG. 1A and provides a schematic of an apparatus including a resistance band-attaching means in accordance with some embodiments. It should be understood that FIG. 9 is intended to provide a basis from which to describe certain features (e.g., resistance band-attaching means) of apparatuses for the systems and methods for physical exercise provided herein. FIG. 9 is not intended to limit the apparatuses for the systems and methods for physical exercise provided herein, and the certain features (e.g., resistance band-attaching means) described in reference to FIG. 9 are not limited thereto.

As shown in FIG. 9, an apparatus 900 (side view) may include a top member 110, a bottom member 120, a movement-enabling mechanism 130, and an optional component 140 configured to couple with one or more anatomical appendages or structures thereof (e.g., hand, forearm, foot, shin, etc.). The top member 110, the bottom member 120, the movement-enabling mechanism 130 (e.g., gliding mechanism, rolling mechanism, etc.), and the component 140 may be configured as described herein. As shown in FIG. 9, the apparatus 900 may include a resistance band-attaching means 960 including one or more eye fasteners 962 (e.g., an eye fastener 962*a*; an eye fastener 962*b*; etc.) affixed to a side of the apparatus 900. The one or more eye fasteners 962 may be affixed to a side surface of the top member 110, a side surface of the bottom member 120, or a combination of the foregoing. Attaching one or more resistance bands to an eye fastener affixed to a side surface of the top member 110 provides more stability to an apparatus from tipping over than attaching one or more resistance bands to an eye fastener affixed to a side surface of the bottom member 120; however, it may be desirable to attach one or more resistance bands to an eye fastener affixed to a side surface of the bottom member 120 for greater strength development.

It should be understood that the one or more eye fasteners 962 are not limited to the apparatus of FIG. 9. The one or more eye fasteners 962 may also be used in apparatuses similar to those described in reference to at least FIGS. 1B, 1C, and 1D.

FIG. 10A expands upon at least FIG. 1A and provides a schematic of an apparatus including a resistance band-attaching means in accordance with some embodiments. It should be understood that FIG. 10A is intended to provide a basis from which to describe certain features (e.g., resistance band-attaching means) of apparatuses for the systems and methods for physical exercise provided herein. FIG. 10A is not intended to limit the apparatuses for the systems and methods for physical exercise provided herein, and the certain features (e.g., resistance band-attaching means) described in reference to FIG. 10A are not limited thereto.

As shown in FIG. 10A, an apparatus 1000A (side view) may include a top member 110, a bottom member 120, a movement-enabling mechanism 130, and an optional component 140 configured to couple with one or more anatomical appendages or structures thereof (e.g., hand, forearm, foot, shin, etc.). The top member 110, the bottom member 120, the movement-enabling mechanism 130 (e.g., gliding mechanism, rolling mechanism, etc.), and the component 140 may be configured as described herein. As shown in FIG. 10A, the apparatus 1000A may include a resistance band-attaching means 960 including a ring 1062 independently rotatably attached to the apparatus 1000A for attaching one or more resistance bands. The ring 1062 may be rotatably attached about the bottom member 120 and axially limited to the bottom member 120 by top and bottom limiters 1065. The top and bottom limiters 1065 may be a number of individual projections arranged about the bottom member 120, or each of the top and bottom limiters 1065 may be an annulus about the bottom member 120. The ring 1062 may be alternatively rotatably attached about the top member 110.

FIG. 10B expands upon at least FIG. 1A and provides a schematic of an apparatus including a resistance band-attaching means in accordance with some embodiments. It should be understood that FIG. 10B is intended to provide a basis from which to describe certain features (e.g., resistance band-attaching means) of apparatuses for the systems and methods for physical exercise provided herein. FIG. 10B is not intended to limit the apparatuses for the systems and methods for physical exercise provided herein, and the certain features (e.g., resistance band-attaching means) described in reference to FIG. 10B are not limited thereto.

As shown in FIG. 10B, an apparatus 1000B (side view) may include a top member 110, a bottom member 120, a movement-enabling mechanism 130, and an optional component 140 configured to couple with one or more anatomical appendages or structures thereof (e.g., hand, forearm, foot, shin, etc.). The top member 110, the bottom member 120, the movement-enabling mechanism 130 (e.g., gliding mechanism, rolling mechanism, etc.), and the component 140 may be configured as described herein. As shown in FIG. 10B, the apparatus 1000B may include a resistance band-attaching means 960 including a ring 1062 independently rotatably attached to the apparatus 1000B for attaching one or more resistance bands. The ring 1062 may be rotatably attached about the bottom member 120 and axially limited to the bottom member 120 by limiters 1065 at a top of the ring 1062 and the movement-enabling mechanism 130 at a bottom of the ring 1062. The limiters 1065 may be a number of individual projections arranged about the bottom member 120, or the limiters 1065 may be an annulus about the bottom member 120. As shown in FIG. 10B, the movement-enabling mechanism 130 may have a greater diameter than the bottom member 120 effectively providing an annular limiter at the bottom of the ring 1062. The ring 1062 may be alternatively rotatably attached about the top member 110, and the bottom member 120 may have a greater diameter than the top member 110, thereby providing the annular limiter.

FIG. 10C provides a schematic of a ring for a resistance band-attaching means in accordance with some embodiments of the systems and methods for physical exercise provided herein As shown in FIG. 10C, an apparatus (e.g., the apparatus 1000A; the apparatus 1000B; etc.) may include a ring 1062 (top view) including a number of through holes 1064 (e.g., a through hole 1064*a*; a through hole 1064*b*; etc.) for attaching one or more resistance bands. Because the ring 1062 is configured to be independently rotatably attached to the apparatus (e.g., the apparatus 1000A; the apparatus 1000B; etc.), the ring 1062 may adjust to an applied resistance band-pulling force from one or more resistance bands such that the applied resistance band-pulling force is normal to the apparatus.

FIG. 11 provides a schematic of an apparatus adjusting to an applied resistance band-pulling force in accordance with some embodiments of the systems and methods for physical exercise provided herein.

As shown in FIG. 11, an apparatus 1100 (top view) may include a top member 1110 positioned axially above a rotatably coupled bottom member (not shown), about which bottom member, in turn, a ring 1162 for attaching one or more resistance bands may be independently rotatably attached. As described herein, the ring 1162 may be alternatively independently rotatably attached about the top member 1110.

As shown in FIG. 11, at a time $t_1$, the apparatus 1100 may have a resistance band 1199 attached to the ring 1162 applying a tangential or secantial resistance band-pulling force on the apparatus 1100. The resistance band-pulling force along the resistance band 1199 is illustrated by the arrow along the resistance band 1199. On account of the ring 1162 being independently rotatably attached to the apparatus 1100, the ring 1162 is configured to rotate in response to the resistance band-pulling force. At a time $t_2$, the ring 1162 independently rotates in response to the resistance band-pulling force as illustrated by the clockwise-oriented arrow leading from the point on the ring 1162 at which the resistance band 1199 is attached. At a time $t_3$, the resistance band 1199 and the resistance band-pulling force is normal or perpendicular to the apparatus 1100, and the clockwise-oriented arrow leading from a visual indicator 1111 (not necessarily part of the apparatus) on the top member 1110 illustrates how the ring 1162 rotated in response to the resistance band-pulling force. The visual indicator 1111 in relation to the point on the ring 1162 at which the resistance band 1199 is attached illustrates an angle through which the ring 1162 rotated in response to the resistance band-pulling force. At a time $t_4$, the apparatus 1100 is set to adjust to another tangential or secantial resistance band-pulling force on the apparatus 1100.

FIG. 12A expands upon at least FIG. 1A and provides a schematic of an apparatus including a resistance band-attaching means in accordance with some embodiments. It should be understood that FIG. 12A is intended to provide a basis from which to describe certain features (e.g., resistance band-attaching means) of apparatuses for the systems and methods for physical exercise provided herein. FIG. 12A is not intended to limit the apparatuses for the systems and methods for physical exercise provided herein, and the certain features (e.g., resistance band-attaching means) described in reference to FIG. 12A are not limited thereto.

As shown in FIG. 12A, an apparatus 1200A (side view) may include a top member 110, a bottom member 120, a movement-enabling mechanism 130, and an optional component 140 configured to couple with one or more anatomical appendages or structures thereof (e.g., hand, forearm, foot, shin, etc.). The top member 110, the bottom member 120, the movement-enabling mechanism 130 (e.g., gliding mechanism, rolling mechanism, etc.), and the component 140 may be configured as described herein. As shown in FIG. 12A, the apparatus 1200A may include a resistance band-attaching means 960 including a track 1262 of a track-and-runner system for attaching one or more resistance bands. The track 1262 of the track-and-runner system may be set in the top member 110 as shown, or the track 1262 of the track-and-runner system 1262 may be set in the bottom member 120.

FIG. 12B expands upon at least FIG. 1B and provides a schematic of an apparatus including a resistance band-attaching means in accordance with some embodiments. It should be understood that FIG. 12B is intended to provide a basis from which to describe certain features (e.g., resistance band-attaching means) of apparatuses for the systems and methods for physical exercise provided herein. FIG. 12B is not intended to limit the apparatuses for the systems and methods for physical exercise provided herein, and the certain features (e.g., resistance band-attaching means) described in reference to FIG. 12B are not limited thereto.

As shown in FIG. 12B, an apparatus 1200B (side view) may include a top member 110, a number of bottom members 120 (e.g., a bottom member 120A; a bottom member 120B; etc.), a number of movement-enabling mechanisms 130 (e.g., a movement-enabling mechanism 130A; a movement-enabling mechanism 130B; etc.), and an optional component 140 configured to couple with one or more anatomical appendages or structures thereof (e.g., hand, forearm, foot, shin, etc.). The top member 110, the number of bottom members 120, the movement-enabling mechanisms 130 (e.g., gliding mechanisms, rolling mechanisms, etc.), and the component 140 may be configured as described herein. As shown in FIG. 12B, the apparatus 1200B may include a resistance band-attaching means 960 including a track 1262 of a track-and-runner system for attaching one or more resistance bands. The track 1262 of the track-and-runner system may be set in the top member 110 as shown, or the track-and-runner system may include a number of tracks respectively set in the number of bottom members 120.

FIG. 12C expands upon at least FIGS. 1C and 1D and provides a schematic of an apparatus including a resistance band-attaching means in accordance with some embodiments. It should be understood that FIG. 12C is intended to provide a basis from which to describe certain features (e.g., resistance band-attaching means) of apparatuses for the systems and methods for physical exercise provided herein. FIG. 12C is not intended to limit the apparatuses for the systems and methods for physical exercise provided herein, and the certain features (e.g., resistance band-attaching means) described in reference to FIG. 12C are not limited thereto.

As shown in FIG. 12C, an apparatus 1200C (side view) may include a number of top members 110 (e.g., a top member 110A; a top member 110B; etc.), a number of bottom members 120 (e.g., a bottom member 120A; a bottom member 120B; etc.), a number of movement-enabling mechanisms 130 (e.g., a movement-enabling mechanism 130A; a movement-enabling mechanism 130B; etc.), and a number of optional components 140 (e.g., a component 140A; a component 140B; etc.) configured to couple with one or more anatomical appendages or structures thereof (e.g., hand, forearm, foot, shin, etc.). The number of top members 110, the number of bottom members 120, the number of movement-enabling mechanisms 130 (e.g., gliding mechanisms, rolling mechanisms, etc.), and the number of components 140 may be configured in stacks with a hinge 105 as described herein. As shown in FIG. 12C, the apparatus 1200C may include a resistance band-attaching means 960 including a number of tracks 1262 (e.g., a track 1262A; a track 1262B; etc.) of a track-and-runner system for attaching one or more resistance bands. The number of tracks 1262 of the track-and-runner system may be respectively set in the number of top members 110 as shown, or the number of tracks 1262 of the track-and-runner system may be respectively set in the number of bottom members 120.

A track-and-runner system may include, but is not limited to, one or more tracks each including one or more runners. FIGS. 13A-13C and FIGS. 14A-14C show non-limiting examples of such runners.

FIGS. 13A, 13B, and 13C provide schematics of a runner for a track-and-runner system in accordance with some embodiments of the systems and methods for physical exercise provided herein.

As shown in FIG. 13A, a runner 1364 (side view) may be integral including a first end 1366 configured for sliding within a track of a track-and-runner system and a second end 1367 configured for attaching one or more resistance bands. As shown in FIG. 13B, the second 1367 end of the runner 1364 (top view) may include a through hole 1368 for attaching the one or more resistance bands. As shown in FIG. 13C, the second end 1367 of the runner 1364 may extend outside the track 1262 to facilitate attaching the one or more resistance bands. The first end 1366 of the runner 1364 may slide within the track 1262 of the top member 110 (in-and-out of the sheet as shown in FIG. 13C) while being held captive in the track 1262.

FIGS. 14A, 14B, and 14C provide schematics of a runner for a track-and-runner system in accordance with some embodiments of the systems and methods for physical exercise provided herein.

As shown in FIG. 14A, a runner 1464 (side view) may include wheels 1466 at a first end of the runner 1464 configured for rolling within a track of a track-and-runner system. As shown in FIG. 14B, the runner 1464 may include a through hole 1468 at a second end of the runner 1464 for attaching one or more resistance bands. As shown in FIG. 14C, the second end of the runner 1464 may extend outside the track 1262 to facilitate attaching the one or more resistance bands. The first end of the runner 1464 may roll within the track 1262 of the top member 110 (in-and-out of the sheet as shown in FIG. 14C) while being held captive in the track 1262.

As shown in FIGS. 13A-13C and 14A-14C, an apparatus (e.g., the apparatus 1200A; the apparatus 1200B; the apparatus 1200C; etc.) may include one or more runners including a through hole for attaching one or more resistance bands. Because each of the one or more runners is configured to independently move (e.g., slide; roll; etc.) within a track of a track-and-runner system of the apparatus, each of the one or more runners may adjust to an applied resistance band-pulling force from one or more resistance bands such that the applied resistance band-pulling force is normal to the apparatus.

FIG. 15 provides a schematic of an apparatus adjusting to an applied resistance band-pulling force in accordance with some embodiments of the systems and methods for physical exercise provided herein.

As shown in FIG. 15, an apparatus 1500 (top view) may include a top member 1510 positioned axially above a rotatably coupled bottom member (not shown), either one of which, or both, may include a track of a track-and-runner system with at least one captive runner 1564 for attaching one or more resistance bands.

As shown in FIG. 15, at a time $t_1$, the apparatus 1500 may have a resistance band 1599 attached to the runner 1564 applying a tangential or secantial resistance band-pulling force on the apparatus 1500. The resistance band-pulling force along the resistance band 1599 is illustrated by the arrow along the resistance band 1599. On account of the runner 1564 being independently moveable within the track, the runner 1564 is configured to move within the track in response to the resistance band-pulling force. At a time $t_2$, the runner 1564 independently moves in the track in response to the resistance band-pulling force as illustrated by the clockwise-oriented arrow leading from the runner 1564. At a time $t_3$, the resistance band 1599 and the resistance band-pulling force is normal or perpendicular to the apparatus 1500, and the clockwise-oriented arrow leading from a visual indicator 1511 (not necessarily part of the apparatus) on the top member 1510 illustrates how the runner 1564 moved in response to the resistance band-pulling force. The visual indicator 1511 in relation to the runner 1564 illustrates an angle through which the runner 1564 moved in response to the resistance band-pulling force. At a time $t_4$, the apparatus 1500 is set to adjust to another tangential or secantial resistance band-pulling force on the apparatus 1500.

One or more apparatuses for the systems and methods for physical exercise provided herein may include a composition having one or more properties selected from high strength, high density, high strength-to-density ratio, high hardness, and high rigidity. Such a composition may include a polymer, a glass, a ceramic, a composite, a metal, a metalloid, a non-metal, or combinations of one or more of the foregoing. For example, the composition may include a metal such as stainless steel. For example, the composition may include a polymer such as an injection-moldable polymer or a 3-D-printable polymer. Such a polymer includes, but is not limited to, one or more polymers selected from high-density polyethylene, nylon (or aliphatic polyamides), polyoxymethylene (or acetal).

Components of the one or more apparatuses provided herein may be separately formed (e.g., by injection molding or 3-D printing) and snapped together for assembly.

In view of the foregoing, examples of apparatuses for the systems and methods for physical exercise include the following apparatuses.

FIG. 16 provides a schematic of an apparatus configured to couple with a hand in accordance with some embodiments of the systems and methods for physical exercise provided herein.

As shown in FIG. 16, an apparatus 1600 (side view) configured to couple with a hand may include a top member 1610, a bottom member 1620 rotatably coupled to the top member 1610 through a turntable bearing 1635, a rolling mechanism 1630 for moving the apparatus 1600 over an extrinsic surface, and a component 1640 configured to couple with a hand. The component 1640 may include a handle 1642 as shown, 1665 load-transmitting balls (also shown as 612) and the handle 1642 may optionally rotate on bearing 1644 for an added degree of freedom, which may be desirable for greater strength development. In addition, the apparatus 1600 may include a resistance-band attaching means 1660 such as that described in reference to at least FIG. 10B.

FIGS. 17A (side view) and 17B (top view) provide schematics of an apparatus configured to couple with a forearm in accordance with some embodiments of the systems and methods for physical exercise provided herein.

As shown in either one or both of FIGS. 17A and 17B, an apparatus 1700 configured to couple with a forearm may include a top member 1710, a number of bottom members 1720 rotatably coupled to the top member 1710 through respective turntable bearings (e.g., turntable bearing 1735), a number of rolling mechanisms 1730 for moving the apparatus 1700 over an extrinsic surface, and a component 1740 configured to couple with a forearm. The component 1740 may include a handle 1742 and a forearm pad 1744 as shown. In addition, the apparatus may include a resistance-band attaching means 1760 such as that described in reference to at least FIG. 12B.

FIGS. 18A (side view) and 18B (top view) provide schematics of an apparatus configured to couple with a foot in accordance with some embodiments of the systems and methods for physical exercise provided herein.

As shown in either one or both of FIGS. 18A and 18B, an apparatus 1800 configured to couple with a foot may include a number of top members 1810, a number of bottom members 1820, a number of rolling mechanisms 1830 for moving the apparatus 1800 over an extrinsic surface, and a number of components 1840 configured to couple with a forearm, which may be arranged in stacks coupled with a hinge 1805 as described in reference to at least FIG. 1C. The component 1840 may include a toe strap 1842 and a heel pad 1844 as shown. In addition, the apparatus may include a side-mounted rolling mechanism 1850 such as that described in reference to at least FIG. 8C, and the apparatus may include a resistance-band attaching means 1860 such as that described in reference to at least FIG. 12C.

FIGS. 19A (side view) and 19B (top view) provide schematics of an apparatus configured to couple with a shin in accordance with some embodiments of the systems and methods for physical exercise provided herein.

As shown in either one or both of FIGS. 19A and 19B, an apparatus 1900 configured to couple with a shin may include a top member 1910, a bottom member 1920, a rolling mechanism 1930 for moving the apparatus 1900 over an extrinsic surface, and a component 1940 configured to couple with a shin. The component 1940 may include a shin pad 1942 and an optional knee pad 1944 as shown. In addition, the apparatus may include a side-mounted rolling mechanism 1950 such as that described in reference to at least FIG. 8A, and the apparatus may include a resistance-band attaching means 1960 such as that described in reference to at least FIG. 12A.

As such, provided herein is an apparatus comprising a top member configured to couple with an anatomical appendage or a structure thereof; a bottom member rotatably attached to the top member; and a movement-enabling means for enabling the apparatus to move across a surface substantially without interruption, wherein the movement-enabling means comprises a turntable bearing between the top member and the bottom member, and a rolling mechanism about a bottom surface of the bottom member. In some embodiments, the anatomical appendage or the structure thereof is selected from a hand, a forearm, a foot, and a shin. In some embodiments, the turntable bearing is configured to compensate for a point of lock up in the rolling mechanism by rotating the bottom member around the point of lock up. In some embodiments, the rolling mechanism comprises a plurality of inverted ball transfer bearings. In some embodiments, the turntable bearing is configured to compensate for a locked up ball transfer bearing by rotating the bottom member around the locked up ball transfer bearing. In some embodiments, the apparatus further comprises a resistance band-attaching means for attaching an end of one or more resistance bands, wherein the resistance band-attaching means is configured to adjust to an applied resistance band-pulling force such that the applied resistance band-pulling force is normal to the apparatus. In some embodiments, the resistance band-attaching means is configured to adjust independently of the top or bottom member. In some embodiments, the resistance band-attaching means comprises a rotatably attached annular member or a track-and-runner mechanism positioned above the bottom member. In some embodiments, the apparatus substantially comprises one or more polymers characteristic of a molding or 3D-printing process.

Also provided herein is an apparatus comprising a top member configured to couple with an anatomical appendage or a structure thereof; a bottom member rotatably attached to the top member; a turntable bearing between the top member and the bottom member; and a rolling mechanism about a bottom surface of the bottom member, wherein the turntable bearing is configured to compensate for a point of lock up in the rolling mechanism by rotating the bottom member around the point of lock up. In some embodiments, the rolling mechanism comprises a plurality of inverted ball transfer bearings arranged in an annulus about the bottom surface of the bottom member. In some embodiments, the turntable bearing is configured to compensate for a locked up ball transfer bearing by rotating the bottom member around the locked up ball transfer bearing. In some embodiments, a radius of the turntable bearing is equal to or greater than a radius of the annulus in which the plurality of ball transfer bearings are arranged. In some embodiments, the apparatus further comprises a rotatably attached annular member positioned above the bottom member for attaching an end of one or more resistance bands, wherein the annular member is configured to adjust to an applied resistance band-pulling force such that the applied resistance band-pulling force is normal to the apparatus. In some embodiments, the apparatus substantially comprises one or more polymers characteristic of an injection molding process. In some embodiments, the apparatus is configured to bear a weight of at least 100 kg.

Also provided herein is an apparatus comprising a top member including a coupling component; a bottom member rotatably attached to the top member; and a movement mechanism about a bottom surface of the bottom member, configured to facilitate movement of the apparatus with respect to an extrinsic surface, wherein the top and bottom members are configured to compensate for a point of lock up in the movement mechanism by rotating the bottom member around the point of lock up. In some embodiments, the movement mechanism comprises a plurality of inverted ball transfer bearings arranged in an annulus about the bottom surface of the bottom member. In some embodiments, a turntable bearing between the top member and the bottom member is configured to compensate for a locked up ball transfer bearing by rotating the bottom member around the locked up ball transfer bearing. In some embodiments, a radius of the turntable bearing is equal to or greater than a radius of the annulus in which the plurality of ball transfer bearings are arranged. In some embodiments, the apparatus further comprises a rotatably attached annular member positioned above the bottom member for attaching an end of one or more resistance bands, wherein the annular member is configured to adjust to an applied resistance band-pulling force such that the applied resistance band-pulling force is normal to the apparatus. In some embodiments, the apparatus substantially comprises one or more polymers characteristic of an injection molding process. In some embodiments, the apparatus is configured for omni-directional movement under a weight of at least 100 kg.

Also provided herein is an apparatus comprising a top member, optionally configured to couple with an anatomical appendage or a structure thereof; a bottom member rotatably attached to the top member; a turntable bearing between the top member and the bottom member; and a plurality of inverted ball transfer bearings arranged in an annulus about a bottom surface of the bottom member, wherein a radius of the turntable bearing is sufficient in magnitude to enable the bottom member to rotate around a locked up ball transfer bearing without interrupting movement of the apparatus across a surface. In some embodiments, the radius of the turntable bearing is equal to or greater than a radius of the annulus in which the plurality of ball transfer bearings are arranged. In some embodiments, the apparatus further comprises a track-and-runner mechanism positioned above the bottom member for attaching an end of one or more resistance bands, wherein the track-and-runner mechanism is configured to adjust to an applied resistance band-pulling force such that the applied resistance band-pulling force is normal to the apparatus. In some embodiments, the apparatus substantially comprises one or more polymers characteristic of a 3D-printing process.

While some particular embodiments have been provided herein, and while the particular embodiments have been provided in considerable detail, the particular embodiments do not limit the scope of the inventive concepts provided herein. Adaptations and/or modifications may appear to persons having ordinary skill in the art, and such adaptations and/or modifications may also be within the scope of the inventive concepts provided herein. Accordingly, departures may be made from the particular embodiments provided herein without departing from the scope of the inventive concepts provided herein.

What is claimed is:

1. An apparatus comprising a top member comprising two vertical sections joined together by a horizontal section, where the top member is configured to couple to a handle with two ends, such that each end of the handle attaches to one of the vertical sections of the top member;

two bearings, each bearing connected between the end of the handle and the vertical section of the top member, such that the bearing surrounds a circumference of the handle, allowing the handle to rotate with respect to the top member; the handle being configured to couple to an anatomical appendage;

a bottom member rotatably attached to the top member and a turntable bearing between the top member and the bottom member for a multidirectional rotation movement; and at least one rolling mechanism having a ball transfer bearing and a plurality of recirculating load transmitting balls about a bottom surface of the bottom member, wherein the rolling mechanism is assembled by adding the recirculating load transmitting balls in a plurality of layers to a top housing and the ball transfer bearing is placed on top of the recirculating load transmitting balls in the bottom housing and wherein the top housing and the bottom housing is snap fitted without any openings to form the rolling mechanism.

2. The apparatus of claim 1, wherein the at least one rolling mechanism comprises a plurality of inverted ball transfer bearings.

3. The apparatus of claim 2, wherein the turntable bearing is configured to compensate for a locked up in one of the plurality of inverted ball transfer bearing by rotating the bottom member around the locked up.

4. The apparatus of claim 1, further comprising a resistance band-attaching means for attaching an end of one or more resistance bands.

5. The apparatus of claim 4, wherein the resistance band-attaching means is configured to adjust independently of the top or bottom member.

6. The apparatus of claim 1, wherein the at least one rolling mechanism has a plurality of inverted ball transfer bearings arranged in an annulus about the bottom surface of the bottom member.

7. The apparatus of claim 6, wherein a radius of the turntable bearing is equal to or greater than a radius of the annulus in which the plurality of ball transfer bearings are arranged.

8. The apparatus of claim 1, wherein the anatomical appendage is selected from a hand, a forearm, a foot, and a shin.

9. The apparatus of claim 1, wherein the turntable bearing is configured to compensate for a point of lock up in the at least one rolling mechanism by rotating the bottom member around the point of lock up.

10. The apparatus of claim 1, wherein the apparatus is configured for omni-directional movement under a weight of at least 100 kg.

* * * * *